US005382207A

United States Patent [19]

Skowronski et al.

[11] Patent Number: 5,382,207

[45] Date of Patent: Jan. 17, 1995

[54] EXERCISE TREADMILL

[75] Inventors: Richard E. Skowronski, Elk Grove Village; Kenneth F. Lantz, Oak Park; Tomas F. Leon, Chicago, all of Ill.; Donald J. Alexander, Milwaukee, Wis.; George Kolomayets, Chicago, Ill.; Vincent C. Adams, Buffalo Grove, Ill.; Eugene B. Szymczak, Glen Ellyn, Ill.

[73] Assignee: Life Fitness, Franklin Park, Ill.

[21] Appl. No.: 686,906

[22] Filed: Apr. 17, 1991

Related U.S. Application Data

[63] Continuation-in-part of Ser. No. 452,885, Dec. 19, 1989, abandoned, which is a continuation-in-part of Ser. No. 368,450, Jun. 19, 1989, abandoned.

[51] Int. Cl.[6] ..... A63B 22/02

[52] U.S. Cl. ..... 482/54; 482/6; 482/900; 482/901; 482/904; 198/807; 474/101

[58] Field of Search ..... 482/1, 4–8, 482/51–54, 900–904; 128/25 R, 25 B; 198/807, 835, 841, 843; 474/101, 140

[56] References Cited

U.S. PATENT DOCUMENTS

| | | | |
|---|---|---|---|
| 3,364,556 | 12/1982 | Otte . | |
| 3,689,066 | 9/1972 | Hagen | 198/811 X |
| 3,711,812 | 1/1973 | Churry | 482/54 X |
| 3,824,067 | 7/1974 | Voshel | 198/841 X |
| 4,095,371 | 6/1978 | Knippel | 49/220 X |
| 4,344,616 | 8/1982 | Ogden . | |
| 4,350,336 | 9/1982 | Hanford . | |
| 4,358,105 | 11/1982 | Sweeney, Jr. | 482/5 |
| 4,445,683 | 5/1984 | Ogden | 482/54 |
| 4,659,074 | 4/1987 | Taitel et al. | 482/54 |
| 4,660,247 | 4/1987 | Frohbietor et al. | 15/339 |
| 4,693,363 | 9/1987 | Kuehnert | 198/807 |
| 4,696,357 | 9/1987 | Beehler et al. | 177/145 |
| 4,766,996 | 8/1988 | Gibson | 198/780 |
| 4,786,049 | 11/1988 | Lautenschlager | 482/902 X |
| 4,842,266 | 6/1989 | Sweeney, Sr. et al. | 482/54 |
| 4,927,138 | 5/1990 | Ferrari | 482/91 |
| 4,938,475 | 7/1990 | Sargeant et al. | 482/902 X |
| 4,959,040 | 9/1990 | Gardnor et al. | 198/807 X |
| 5,007,528 | 4/1991 | Hideharu | 198/841 X |

FOREIGN PATENT DOCUMENTS

| | | | |
|---|---|---|---|
| 1432392 | 2/1966 | France . | |
| 2616132 | 12/1988 | France . | |
| 2184361 | 6/1987 | United Kingdom . | |
| 1347953 | 10/1987 | U.S.S.R. | 482/54 |

*Primary Examiner*—Richard J. Apley
*Assistant Examiner*—Joe H. Cheng
*Attorney, Agent, or Firm*—Michael B. McMurry

[57] ABSTRACT

To improve tracking, an exercise treadmill is provided with a frame including molded plastic pulleys, having an integral gear belt sprocket, an endless belt extending around the pulleys and a motor operatively connected to the rear pulley to drive the belt. The pulleys are molded out of plastic and have a diameter of approximately nine inches. A mold and method for producing large diameter treadmill pulleys having an integrally molded sprocket are also disclosed. A deck underneath the running surface of the belt is supported by resilient members. A positive lateral belt tracking mechanism is used to correct the lateral position of the belt. A belt position sensor mechanism is used in combination with a front pulley pivoting mechanism to maintain the belt in the desired lateral position on the pulleys. The exercise treadmill also includes a lift mechanism with an internally threaded sleeve engaged to vertically aligned nonrotating screws. A user display of foot impact force on the belt is also provided.

39 Claims, 18 Drawing Sheets

EXERCISE TREADMILL

This application is a continuation-in-part of U.S. Ser. No. 07/452,885, filed Dec. 19, 1989 now abandoned, which itself was a continuation-in-part of U.S. Ser. No. 07/368,450, filed Jun. 19, 1989, now abandoned.

FIELD OF THE INVENTION

The invention generally relates to exercise equipment and in particular to exercise treadmills.

BACKGROUND OF THE INVENTION

Exercise treadmills are widely used for various purposes. Exercise treadmills are, for example, used for performing walking or running aerobic-type exercise while the user remains in a relatively stationary position. Further, exercise treadmills are used for diagnostic and therapeutic purposes. For all of these purposes, the person on the exercise treadmill normally performs an exercise routine at a relatively steady and continuous level of physical activity. Examples of such treadmills are illustrated in U.S. Pat. Nos. 4,635,928, 4,659,074, 4,664,371, 4,334,676, 4,635,927, 4,643,418, 4,749,181, 4,614,337 and 3,711,812.

Exercise treadmills typically have an endless running surface which is extended between and movable around two substantially parallel pulleys at each end of the treadmill. The running surface may be comprised of a belt of a rubber-like material, or alternatively, the running surface may be comprised of a number of slats positioned substantially parallel to one another attached to one or more bands which are extended around the pulleys. In either case, the belt or band is relatively thin. The belt is normally driven by a motor rotating the front pulley. The speed of the motor is adjustable by the user so that the level of exercise can be adjusted to simulate running or walking as desired.

The belt is typically supported along at least its upper length between the pulleys by one of several well-known designs in order to support the weight of the user. For example, rollers may be positioned directly below the belt to support the weight of the user. Another approach is to provide a deck or support surface beneath the belt, such as a wood panel, in order to provide the required support. Here a low-friction sheet or laminate is usually provided on the deck surface to reduce the friction between the deck surface and the belt. Because the belt engages the deck surface, friction between the belt and the deck arises and the belt is therefore subject to wear. Further, most of the decks are rigid resulting in high impact loads as the user's feet contact the belt and the deck. This is often perceived by users as being uncomfortable and further can result in unnecessary damage to joints as compared to running on a softer surface.

Because the typical treadmill has a very stiff, hard running surface and can become uncomfortable for extended periods of running, some manufacturers have applied a resilient coating to the running surface, such as rubber or carpeting, to reduce foot impact. Unfortunately, these surfaces for the most part have not provided the desired level of comfort because the running surface tends to retain its inherent stiffness. Attempts to solve this problem by using a thicker belt to provide a more shock absorbent running surface have not been successful for the reasons given in U.S. Pat. No. 4,614,337. Specifically, the thickness of the belt has to be limited in order to limit the belt drive power to reasonable levels. In other words, the thicker the belt, the more power that is required to drive the pulley. To keep motor size cost effective, it has been necessary to keep the belt relatively thin. As discussed below, the power of the motor required to drive a pulley is also related to the size of the pulleys.

Pulleys used in current exercise treadmills typically are made of steel or aluminum and as such are relatively expensive to make and are relatively heavy. Therefore, because of tooling, manufacturing and material costs, the diameter of the pulleys are normally no larger than three to four inches.

Additionally, the diameter of the pulley directly affects the power required to rotate the pulley as does the thickness of the belt. If the diameter of the pulleys is relatively small, the thickness of the belt must be kept relatively thin. As the diameter of the pulley is increased, the belt may be made thicker for the same amount of power available to drive the pulleys. As discussed above, the thicker the belt, the more shock the belt will absorb.

A further disadvantage of smaller pulleys results from the fact that the reduced surface area of the pulley contacting the belt requires increased tension in the belt in order to transfer torque from the treadmill motor to the belt. In some cases, this increased tension can result in decreased belt life.

The pulleys used in current exercise treadmills are typically of a "convex" or of a "cambered" design and as such have a substantially inwardly sloping profile with a portion of the pulley having a larger diameter, or crown, at the center. The convex-type pulley has a rounded crown at its center portion and the cambered-type pulley has a cylindrical center section between conical ends. The purpose of using these two types of pulleys is to maintain "tracking" of the belt because the belt is less likely to slide from side to side on the pulley during rotation if the pulley has a crown. Unfortunately, belts on convex- or camber-type pulleys also tend to be sensitive to improper adjustment and side loading, which can occur when the user is not running on the center of the belt.

Another source of belt wear on existing exercise treadmills results from driving the front belt pulley instead of the rear belt pulley. In a front drive arrangement, the belt has a tendency to develop a slack portion on the upper or running surface of the belt. This tends to increase belt wear. Because existing treadmills have relatively small diameter belt pulleys, it has not been practical to locate the drive motor such that the rear belt pulley can be driven by the motor.

Because most pulleys use the convex- or camber-type configuration as a belt guide, the belts are still sensitive to improper adjustment and side loading. A system whereby a more positive, lateral "tracking" or guidance of the belt is achieved during rotation is therefore desirable.

Many current exercise treadmills also have the ability to provide a variable incline to the treadmill- Normally, the entire apparatus is inclined, not just the running surface. There are a number of exercise treadmills having manual or power driven inclination systems to take advantage of the fact that the exercise effort, or aerobic effect, can be varied greatly with small changes in inclination. For example, a seven percent grade doubles the aerobic or cardiovascular effort compared to level walking or running exercise.

Current inclination or lift mechanisms typically comprise a toothed post in a rack-and-pinion arrangement or a threaded post on which a sprocket attached to the treadmill frame is rotated upwards to lift the treadmill. In both arrangements, the post must be at a height equivalent to the height of travel of the treadmill frame to accommodate the travel of the pinion or sprocket. The length of the post tends to compromise the aesthetics of the treadmill because the post has to extend beyond the plane of the running surface to provide the desired inclination of the running surface. Therefore, a lift mechanism with a large extension rotation which would fit primarily within the treadmill enclosure is desirable.

The treadmill user's stride also effects the user's body because the resultant force on the user's body increases as the stride increases. If the user is running relatively hard, especially over an extended period of time, physical damage to the user's feet and legs can occur. The larger the resultant force the greater the likelihood of physical damage. If a user's stride results in a force (measured in pounds) which is about equal to or greater than twice the user's body weight, the force can be considered excessive. Therefore, a sensor which could measure the force or impact on the treadmill by a user is desirable.

SUMMARY OF THE INVENTION

It is therefore an object of the invention to provide an exercise treadmill having a shock absorbent running surface by providing resilient members to support a deck located under a belt.

It is also an object of the invention to provide molded plastic belt pulleys having a large diameter including a drive gear portion integrally molded into one of the pulleys.

It is a further object of the invention to provide an exercise treadmill in which the belt is driven by the rear belt pulley.

It is a further object of the invention to provide a more positive lateral "tracking" or guidance mechanism for the belt.

It is another object to provide a lift mechanism to incline the treadmill running surface that fits primarily within a treadmill enclosure and intermediate the front and rear pulleys.

It is yet another object of the invention to provide a treadmill capable of sensing the impact of the user's body on the treadmill and capable of providing that information to the user.

It is still another object of the invention to provide a treadmill in which treadmill belt tension can be reduced without sacrificing reliable operation.

In particular, an exercise treadmill is provided in which a belt is supported for a portion of its length between a pair of pulleys and a deck supported by resilient members in combination with a resilient belt. The thickness of the belt is preferably approximately 0.20 inches. Further, the deck is fixed to resilient members at several points, permitting the deck to partially float on the deck frame when stepped upon, resulting in even lower impact loads on the user feet and legs.

The belt pulley construction can be, alternatively, straight cylindrical, convex, or a cylindrical center section and conical ends (cambered). The belt pulleys also have a relatively large diameter, preferably approximately nine inches. The pulleys are of a molded plastic construction and a drive sprocket portion can be molded as part of the pulley. Possible plastic materials from which the pulleys can be molded include glass-filled polypropylene, polystyrene, polycarbonate, polyurethane and polyester. In some embodiments, bearing seat assemblies can be molded-in to the pulley when it is originally manufactured, thereby eliminating the need for inserting and fastening bearing seats into molded pulleys.

The use of large diameter pulleys is facilitated through the use of a plastic construction, rather than a steel construction. The large diameter of the pulleys permits the use of thicker belts which can be made to be more shock-absorbing than currently used belts. User comfort is therefore further enhanced. The larger pulleys also reduce the belt tension required for satisfactory belt drive.

A belt position sensor mechanism provides for positive lateral tracking of the belt. As a result, the belt is prevented from laterally sliding too far to one side of the pulley so that it contacts a frame or other portions of the structure, resulting in a reduction of wear or damage to the belt. This arrangement is also less sensitive to improper adjustment and side loading.

The sensor mechanism includes an arm which is spring biased to one edge of the lower surface of the belt, preferably near the front belt pulley. As the belt moves to one side or the other on the front pulley, the arm moves in the same direction as the lateral movement of the belt. In one of two designs, a Hall effect sensor connected to the arm electrically measures the lateral movement of the belt, and the electrical signals are transmitted to a microprocessor. If correction of the belt position is required, the microprocessor will activate a front pulley pivoting mechanism to pivot one end of the front pulley in a longitudinal direction, either towards the front or towards the rear of the treadmill. Because the belt will tend to move towards the lateral (transverse) direction in which the belt tension is lower, the front pulley will be pivoted towards the front of the treadmill to move the belt to the right, and towards the rear of the treadmill to move the belt to the left. The front pulley pivoting mechanism uses a pivot block for holding one end of the pulley axle and a guide block for the other end of the front axle that selectively moves along a longitudinal path from front to rear to create the pivot. In some embodiments, the pivot mechanism drive motor duty cycle is varied as a function of belt position and speed to optimize belt position corrections.

Also, a lift mechanism for the exercise treadmill is provided which includes an internally threaded sprocket assembly which, when driven, forces a non-rotating screw, threaded to the sprocket assembly against the floor thereby inclining the unit. A lift mechanism with a large extension ratio which can fit primarily within a side enclosure of the treadmill is therefore made possible. In another embodiment, molded sprockets are driven on the screw by a toothed belt, thereby eliminating the need for chain oiling and providing quieter operation than that produced by a chain drive system.

An impact sensor mechanism is also provided to measure the relative force created on the deck by the treadmill user. The impact sensor mechanism includes an arm, having a pair of magnets, which is spring biased against the lower surface of the deck. As the deck flexes downward when the user's feet impact the deck, the impact sensor arm is also deflected downward. A Hall effect sensor secured to the frame between the magnets electrically measures the downward deflection of the deck, and the electrical signals are transmitted to a microprocessor. The downward deflection of the deck is a function of the foot impact force and is related to the compressibility of the resilient support members supporting the deck. The microprocessor calculates the impact force by comparing the measured deflection to empirical values. Also, a relative force value is calculated, based on an inputted value for the user's body weight.

A mold for producing a large diameter pulley having an integral sprocket is also disclosed. In some embodiments, the mold accepts a bearing insert or seat assembly prior to insertion of the plastic pulley material to yield a pulley with a molded-in bearing seat assembly. A method for producing these pulleys is also disclosed.

DETAILED DESCRIPTION OF THE INVENTION

Figure 1:
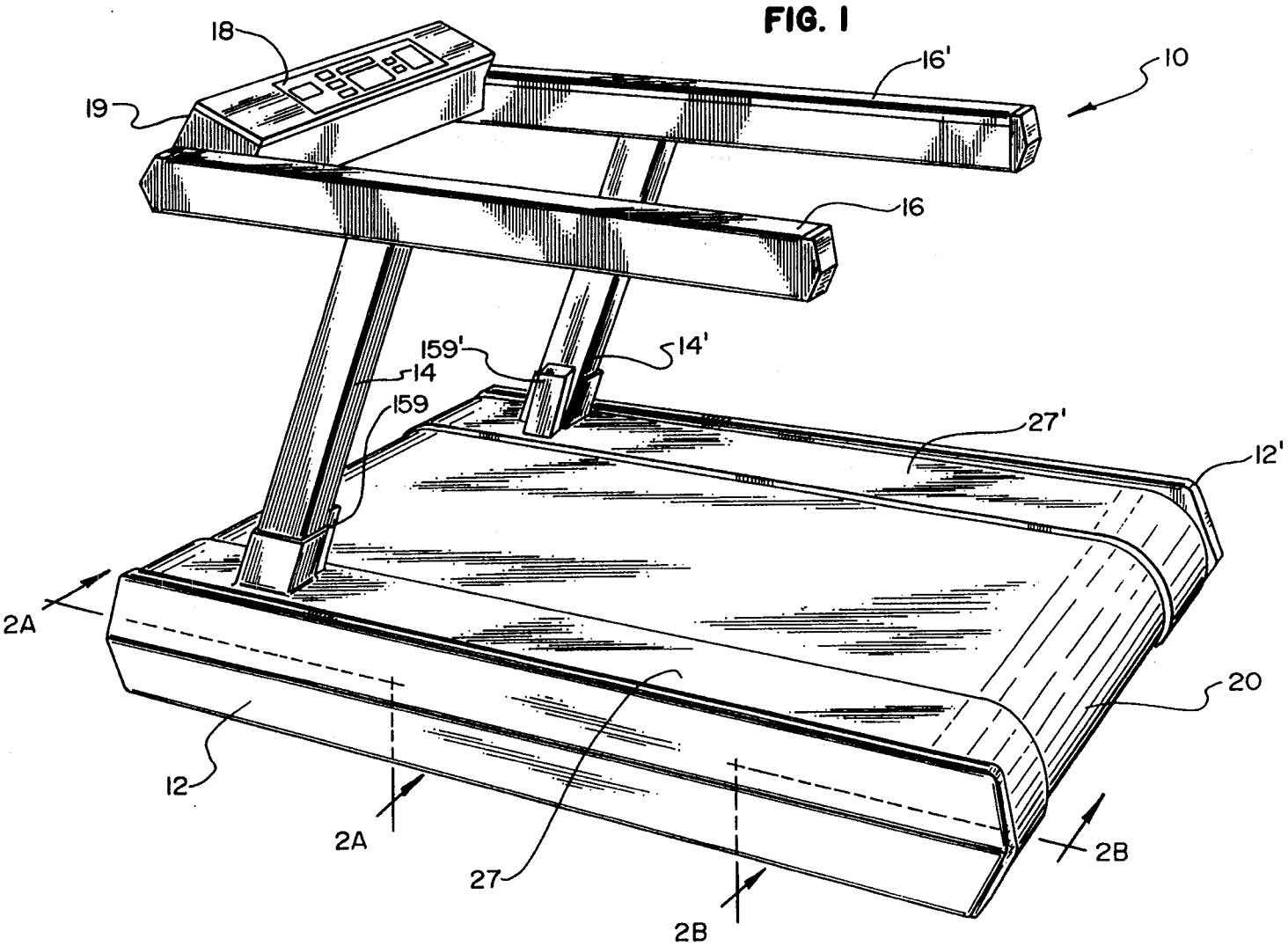
FIG. 1 is a perspective view of an assembled exercise treadmill.

FIG. 1 provides a perspective view of an assembled exercise treadmill 10. The treadmill 10 has a lower frame portions 12 and 12' housing the internal mechanical components of the treadmill 10, as discussed below. Projecting upwardly from frame 12 and 12' are a pair of railing posts 14 and 14'. As illustrated in FIG. 1, railing posts 14 and 14' are slightly tilted from perpendicular relative to lower frame 12 and 12', primarily for aesthetic purposes. Secured to the tops of railing posts 14 and 14' are a pair of side rails 16 and 16', respectively. Side rails 16 and 16' provide the treadmill user with a means of support either during the entire exercise period or for an initial period until the user has assimilated himself to the speed of the treadmill. Extending between and attached to the side rails 16 and 16' is a front rail 17 and a control panel 18 mounted on cross-member 19. Front rail 17 provides yet another means of support for the treadmill user. Control panel 18 includes electronic controls and information displays which are typically provided on exercise treadmills for purposes such as adjusting the speed of treadmill 10 and for operating a lift mechanism for inclining the entire exercise treadmill 10, as will be discussed later in connection with FIG. 16.

In normal operation, the user will step onto a belt 20, positioning himself between the side rails 16 and 16'. As belt 20 begins to move, the user will start a walking motion towards the front of the treadmill 10. Alternatively, the treadmill 10 may be set up to automatically begin to move at a speed according to a value entered from control panel 18. The pace of the walking motion may be increased into a brisk walk or run, depending upon the speed of the belt 20. The speed of belt 20 can be controlled by the adjustment of the controls on panel 18, along with the adjustment of the inclination of the treadmill 10, as will be discussed in connection with FIG. 16.

Figure 2A:
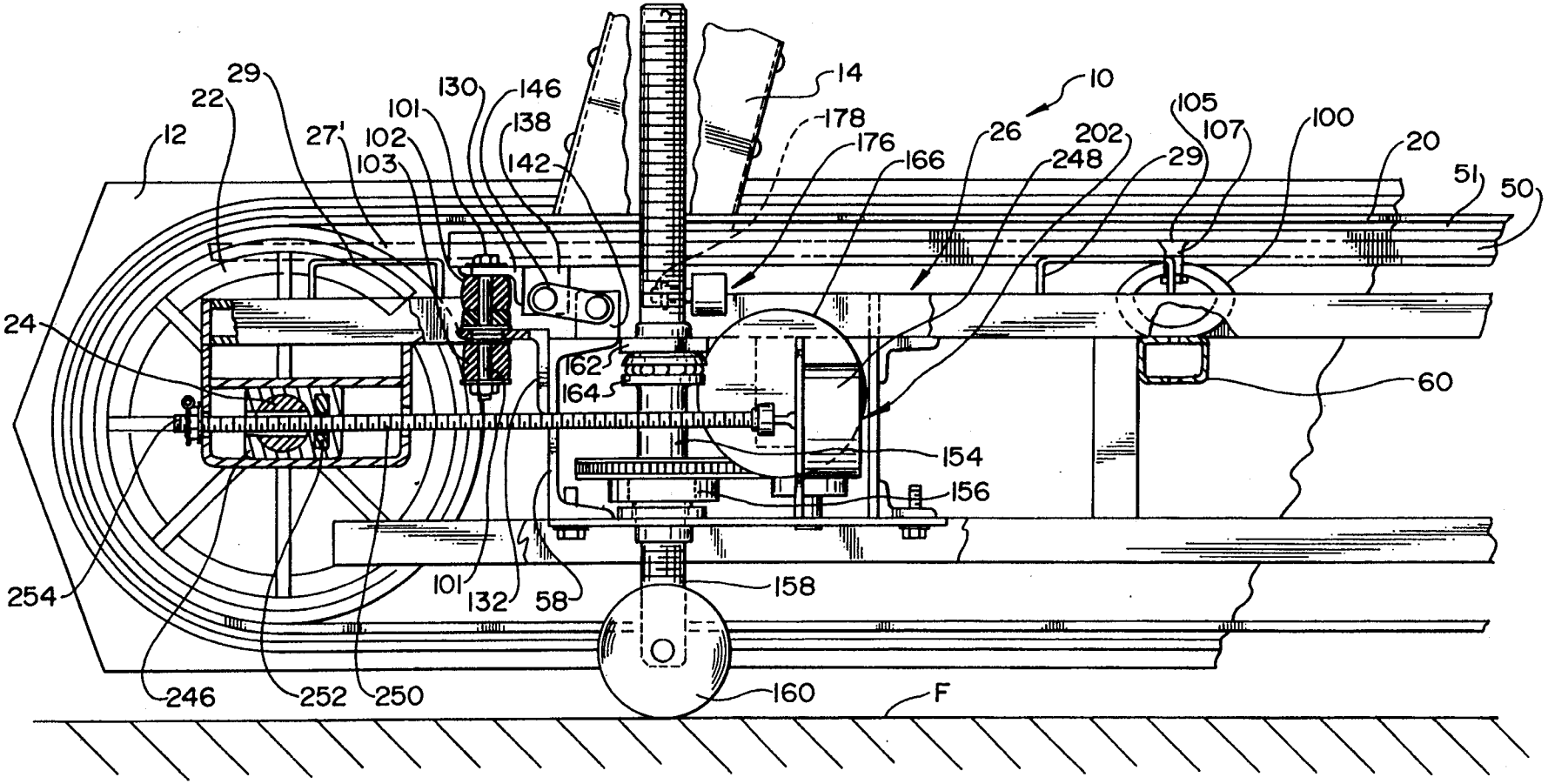
FIGS. 2A and 2B provide sectioned side views along the lines 2A–2A and 2B–2B, respectively of FIGS. 1, 3A and 3C illustrating the internal assembly of the exercise treadmill.
Figure 2B:
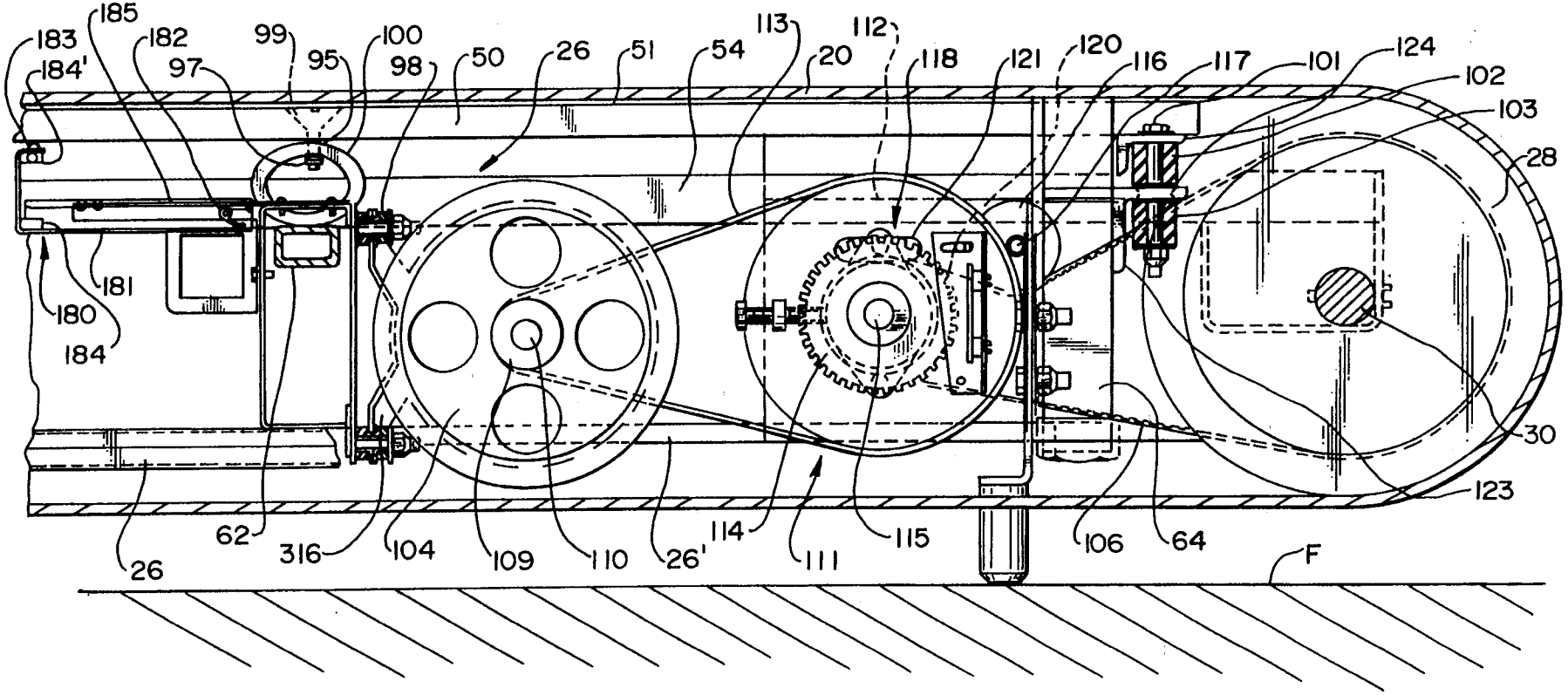
Figures 2C, 3D:
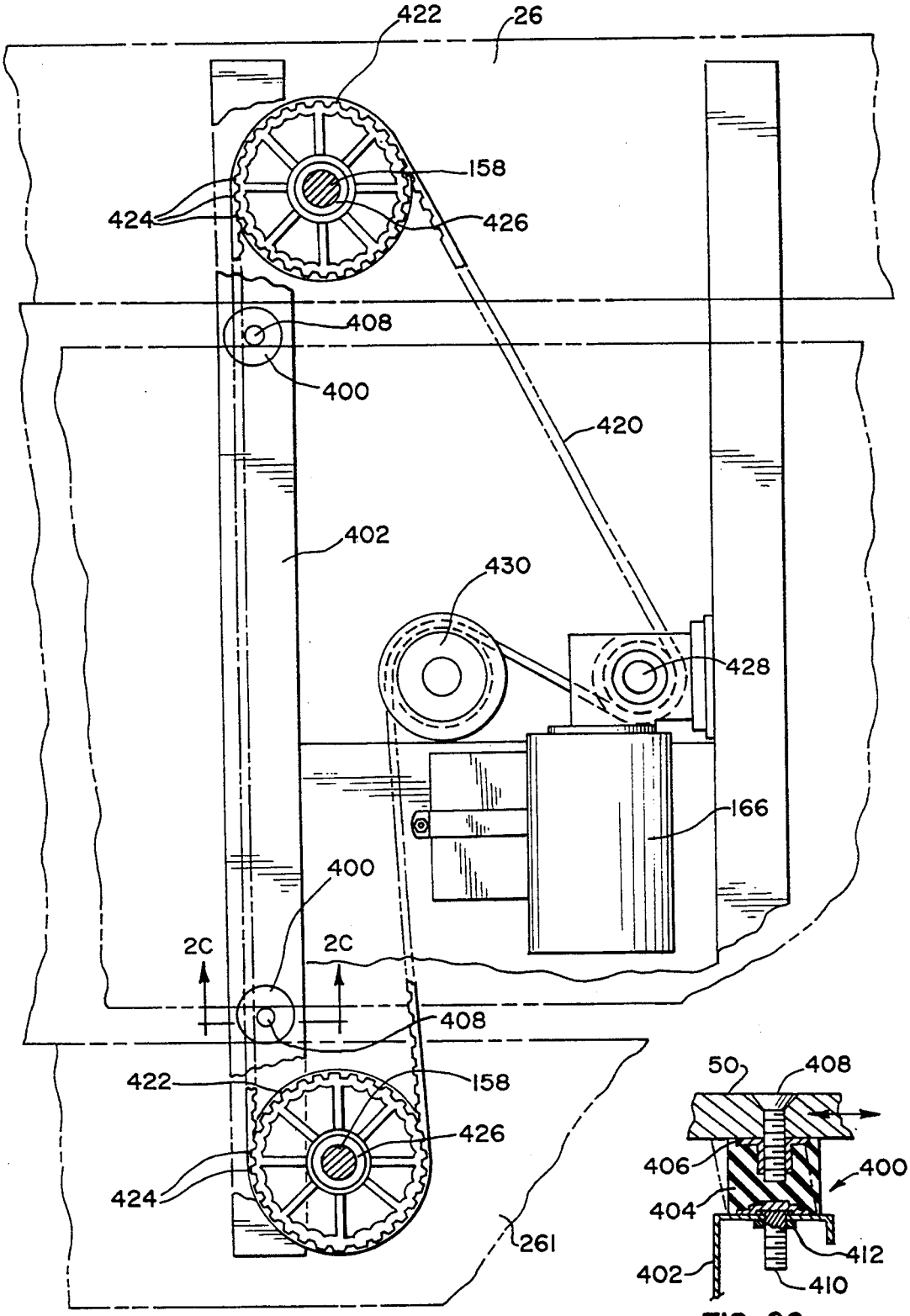
FIG. 2C illustrates an alternative structure for securing the deck to the frame to be used in place of the linkage assembly shown in FIG. 2A.
FIG. 3D illustrates an alternative embodiment of the internal lift assembly which uses a toothed drive belt.
Figure 3A:
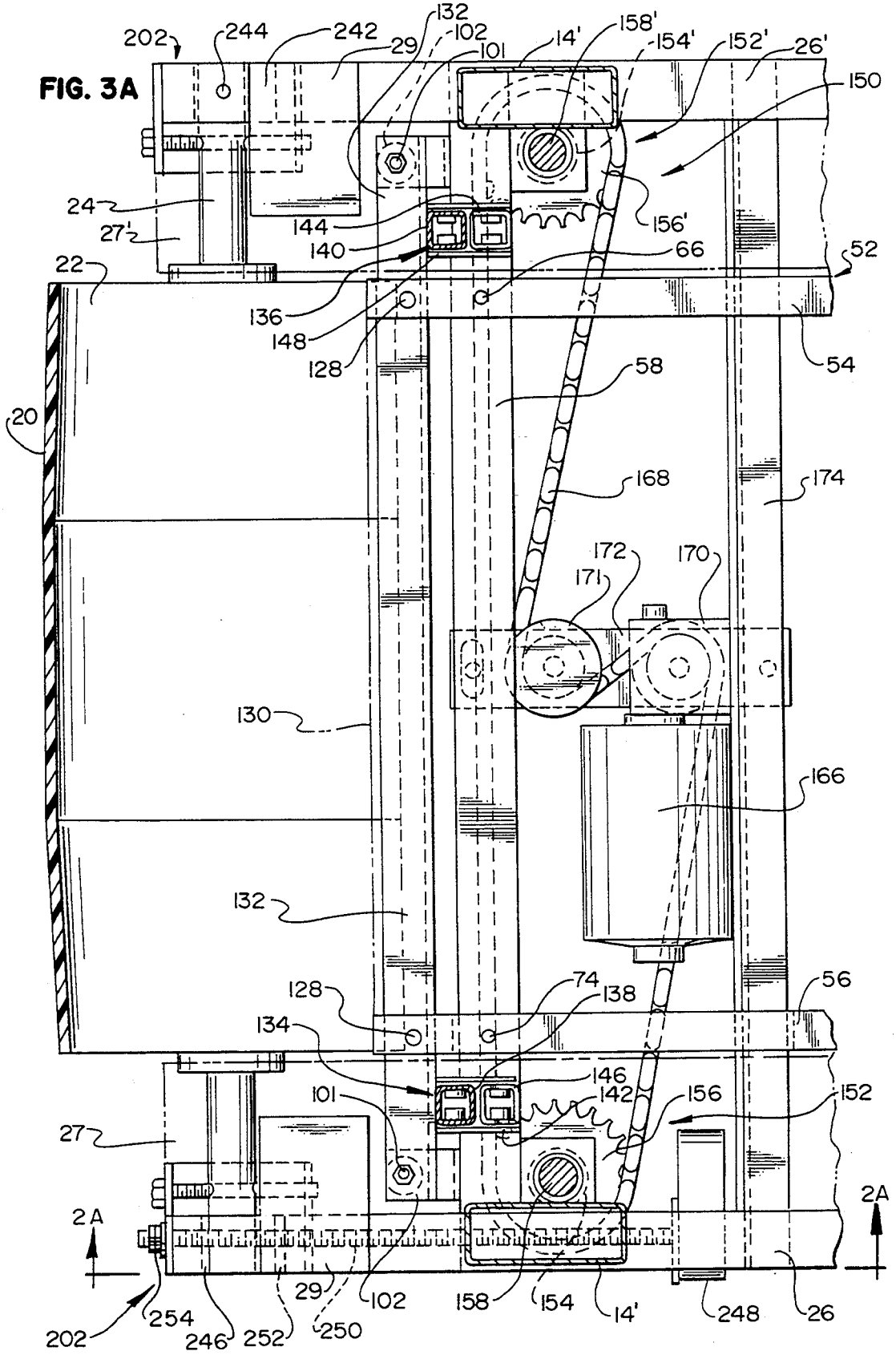
FIGS. 3A, 3B and 3C provide sectioned top views of FIG. 1 from front to back, illustrating the internal lift assembly of the exercise treadmill/and the spacing of spring post assemblies.
Figure 3B:
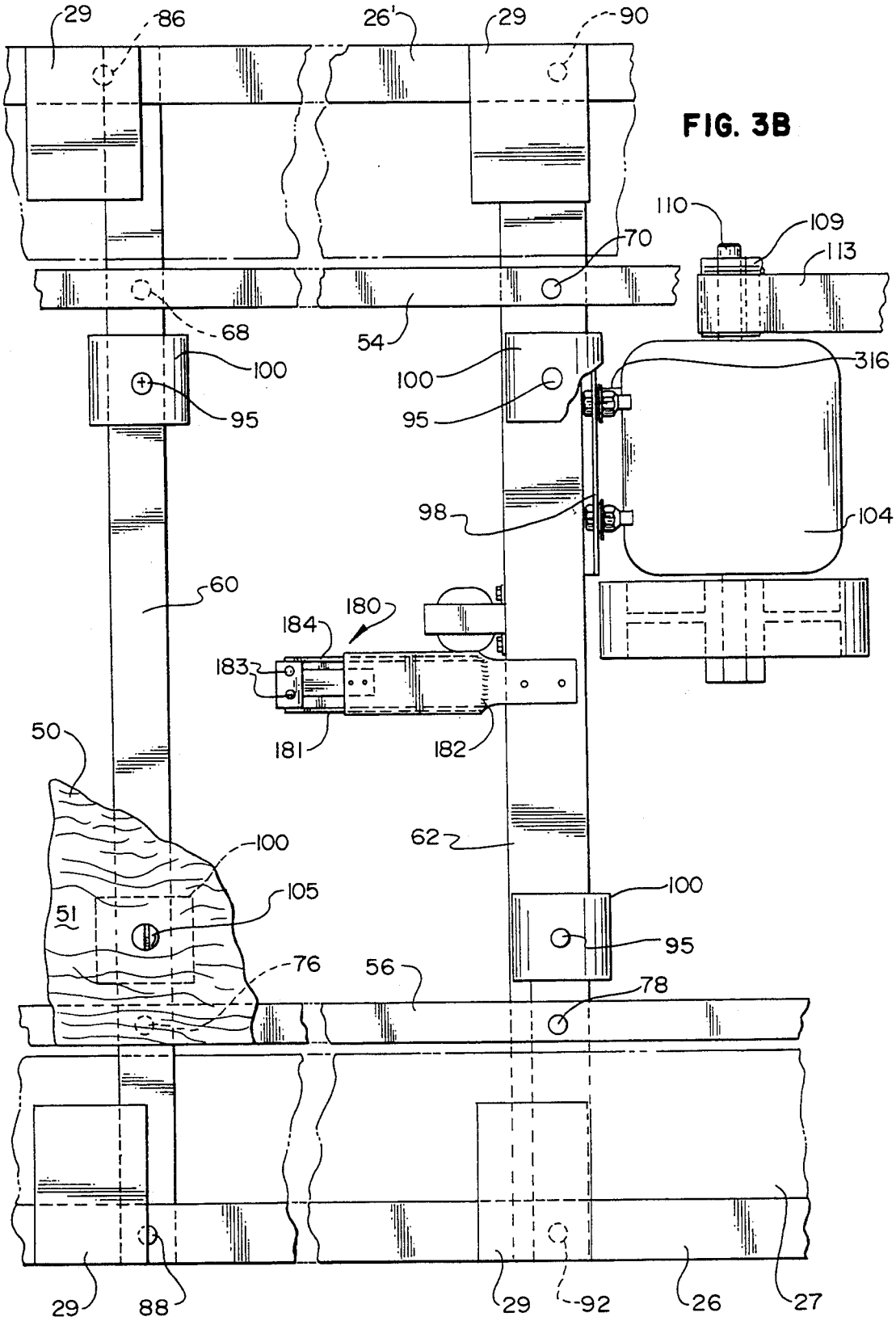
Figure 3C:
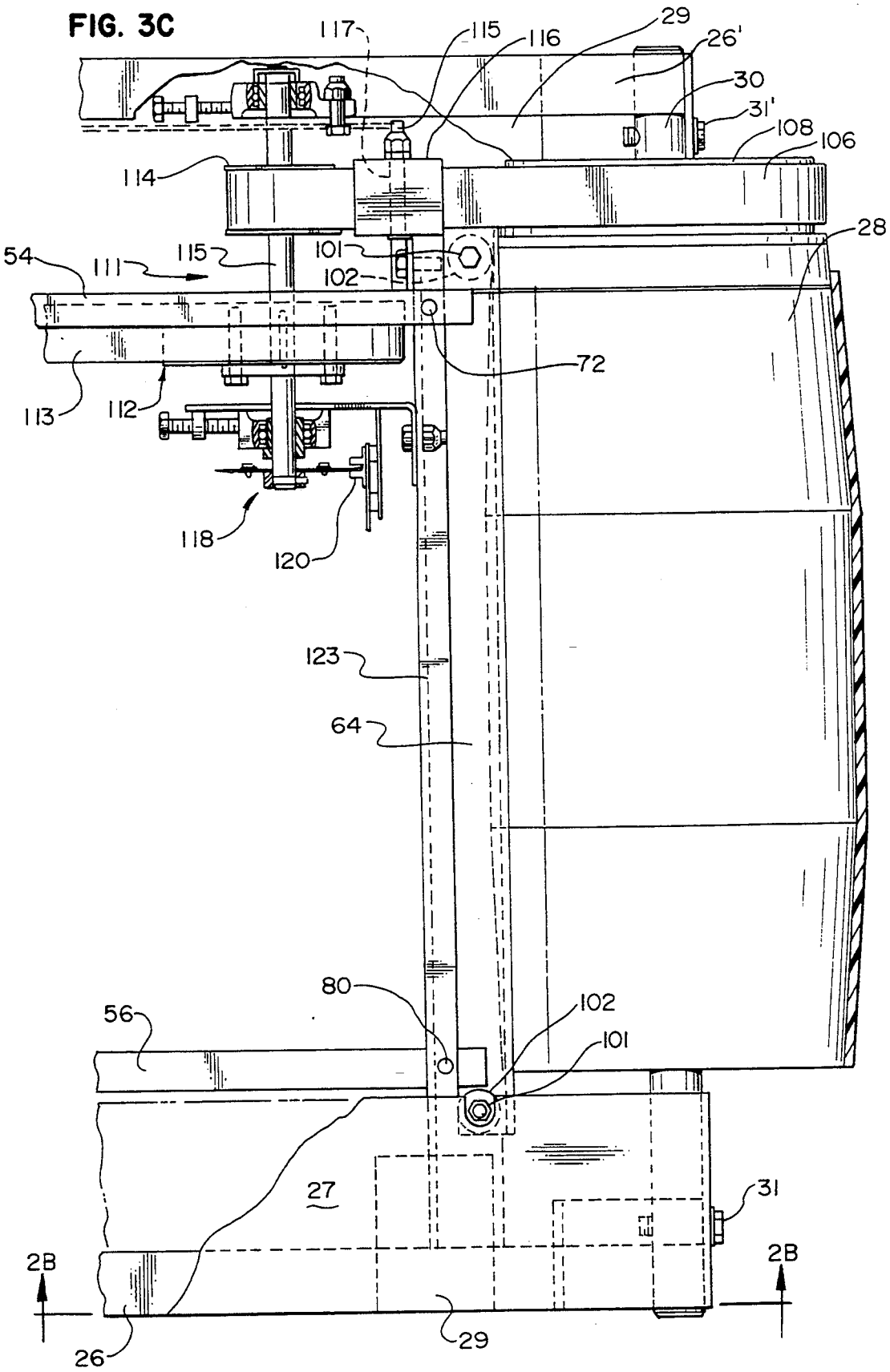

A drive assembly for the belt 20 is generally illustrated in the Figures, and more particularly in FIGS. 2B, 3B and 3C. A front belt pulley 22 is rotatably mounted on a first axle 24. A second, rear belt pulley 28 is rotatably supported on a second axle 30 which is in turn secured to the frame portions 26 and 26' within the frame portions 12 and 12' by fasteners 31 and 31' respectively. Step surfaces 27 and 27' run longitudinally from front to rear of treadmill 10. Surfaces 27 and 27' provide a surface upon which a treadmill user can step onto before, during or after the belt 20 begins to move. Step surfaces 27 and 27' are supported on either frame 26 or 26' by a plurality of support members 29. The rear belt pulley 28 is positioned substantially parallel to the front pulley 22. The belt 20 is looped around pulleys 22 and 28 for movement therearound, to form an upper run or length and a lower run or length of the belt.

The front pulley 22 and rear belt pulley 28 can be of any type of construction, for example, of either a straight cylindrical-type construction, a convex-type construction, or a cylindrical center section and conical ends-type construction (cambered pulley). Convex-type pulleys are especially useful since belts have the natural tendency to stay centered on such a "crowned" pulley. Because convex-type pulleys involve relatively high production costs, cambered-type pulleys can be used instead, with the transitions from the conical sections to the cylindrical section being rounded off in order to approximate a convex shape.

The need for a specific type of pulley, such as a crowned pulley, can be mitigated by the use of a positive lateral belt tracking and positioning mechanism as discussed below. For example, although straight cylindrical pulleys have the poorest belt guidance characteristics of the three types of pulleys already discussed, straight cylindrical-type pulleys can be used in combination with a positive lateral belt tracking mechanism which can correct the lateral position of the belt. The use of a positive lateral tracking arrangement prevents the belt 20 from travelling too far to one side of either pulley 22 or 28 so that belt 20 does not contact either frame portion 26 or 26'. Also, as discussed above, induced stresses and sensitivity to improper adjustment are decreased through the use of this arrangement.

Preferably, the pulleys 22 and 28 are of the same relatively large diameter and in the range of seven to ten inches. The preferred pulleys have a twenty inch longitudinal surface and include a six inch long crowned center portion having a diameter of 9.14 inches which includes a rise of 0.07 inches from the ends of the pulley that have a diameter of 9.00 inches.

The relatively large diameter of pulleys 22 and 28 provides significant performance advantages. One advantage is that the large diameter pulleys permit the use of a relatively thicker belt 20, which can provide more shock absorbency than most currently used belts. The thickness of the preferred belt 20 is about 0.20 inches or more.

A second significant performance advantage of large diameter pulleys stems from the large drive pulley to belt contact area. This large contact area provides enhanced "gripping" of the belt by the pulley, which in turn permits the use of lower belt tension than is required by treadmills having smaller diameter pulleys. This, in turn, reduces or eliminates tension-related belt failure known to occur in treadmills having smaller diameter pulleys. For the preferred nine inch diameter pulley embodiment having a drive pulley to belt contact area of 250 square inches, belt tensions of 50 lbs. per inch of lateral belt width or less are sufficient to provide reliable belt operation with a Siegling belt, Model No. E 812 U0/U4.

Another advantage to larger diameter pulleys is increased belt life. It has been determined that stresses induced in the belt due to bending are decreased with larger diameter pulleys.

Pulleys 22 and 28 are also preferably of a molded plastic construction. Suitable materials from which pulleys 22 and 28 can be molded include glass-filled polypropylene, polystyrene, polycarbonate, polyurethane and polyester. Economical manufacture of the pulleys 22 and 28 having such a relatively large diameter is facilitated through the use of this plastic material. The preferred method of manufacturing pulley 28 is discussed later in conjunction with FIG. 18.

Figure 6:
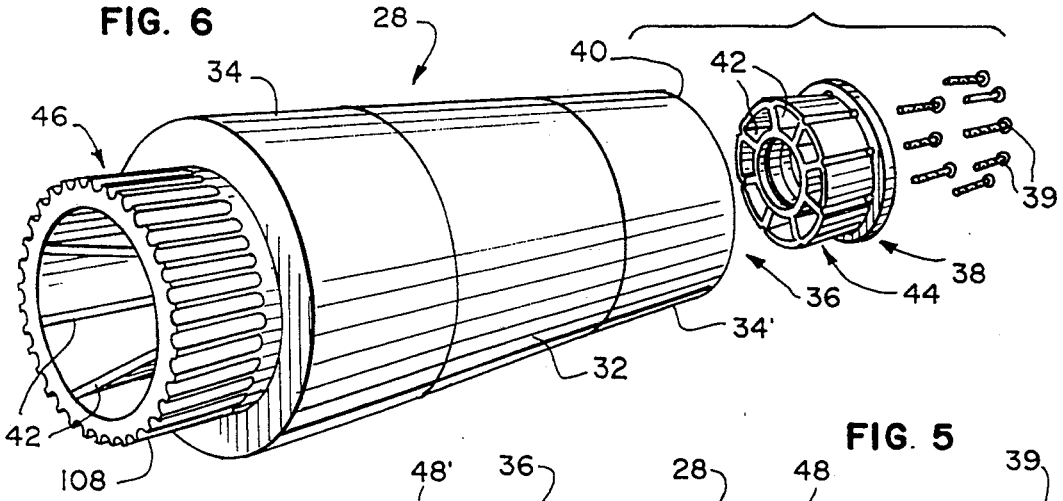
FIG. 6 is an exploded, perspective view of the rear belt pulley of FIG. 5.
Figure 5:
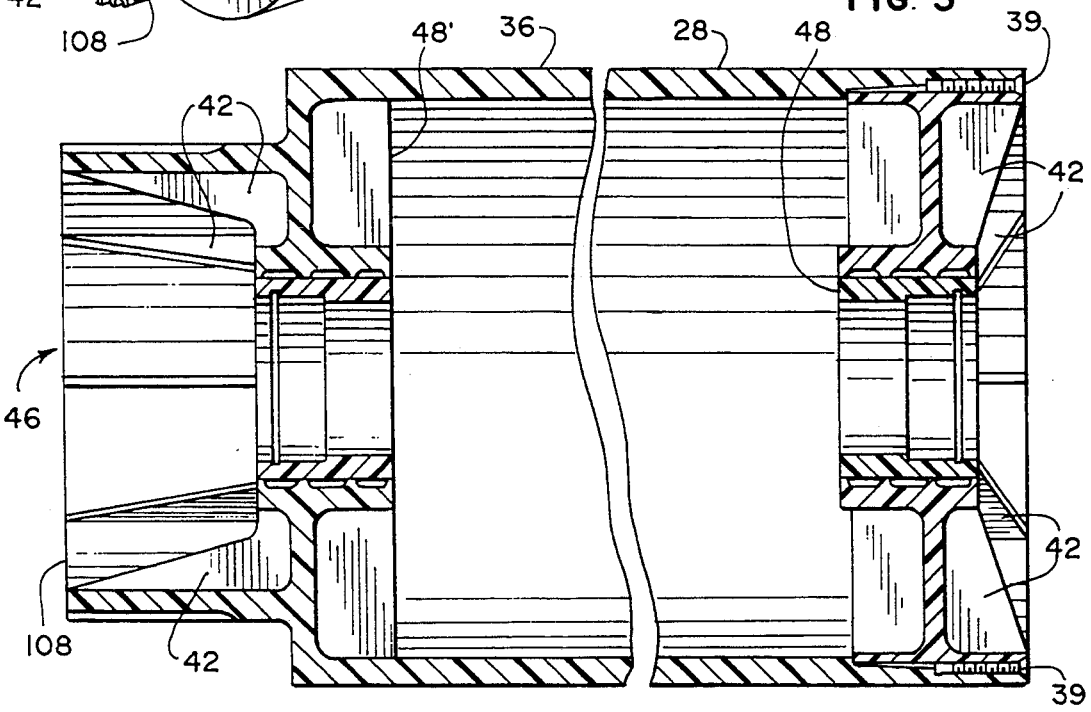
FIG. 5 is a partial sectioned longitudinal view illustrating an assembled cambered-type rear belt pulley.

A two-piece embodiment of the rear pulley 28 is illustrated in FIGS. 5 and 6. Specifically, rear pulley 28 includes a cylindrical body 36 and a second portion or end cap 38. Body 36 includes an integrally molded toothed sprocket 108 at one end. Depending on the desired pulley construction, body 36 is either straight cylindrical, convex or has a cylindrical center section with conical ends. Preferably, as illustrated, body 36 has a cylindrical center section 32 with conical ends 34 and 34', generally known as a cambered-type pulley. A number of angularly spaced support elements indicated by reference numeral 42 are integrally molded within the end cap 38 and sprocket 108 to provide structural rigidity. A portion 44 of the molded cap 38 extends into the end 40 of cambered body 36. The molded cap 38 is secured to the cambered body 36 by any one of a variety of known securing means including the press fit arrangement shown in FIGS. 5 and 6. In addition to the press fit arrangement, eight flat head screws 37 can be used to secure cambered body 36 and cap 38 together. Molded cap 38 and the other, integral end 46 of the cambered body 36 each include a bearing seat assembly 48 and 48' (FIG. 5), respectively, for attachment to the second axle 30. The use of molded-in bearing seats allows easy insertion of bearing rings (not shown) after the pulley has been molded. Bearing seats 48 and 48' are preferably molded into pulleys 22 and 28 when pulleys 22 and 28 are originally manufactured. Front pulley 22 can be molded by a similar process, but, of course, does not include an integral sprocket.

As a user steps on the belt 20 during normal operation of the treadmill 10, the belt 20 will tend to flex or bend under the weight of the user. The belt 20 is supported for a portion of its length between the pulleys 22 and 28 by a deck 50, as shown in FIGS. 2A and 2B. Deck 50 can be made of any suitable material, preferably maple hardwood or a suitable composite material, and provides a support surface located such that the belt 20 will flex or bend downwardly until it contacts the top surface 51 of deck 50. The thickness of deck 50 also partially determines the downward flex of the deck 50. For example, a deck thickness of $\frac{5}{8}$ths inches provides more of a flex than a deck thickness of $\frac{3}{4}$ths inches. Generally, the downward flex of deck 50 increases with decreasing deck thickness. The thickness of deck 50 is therefore chosen to provide a desired flex.

To reduce friction between the underside of the upper run of belt 20 and the top surface 51 of deck 50, a low friction laminate or other coating can be applied to either the top surface 51 of the deck 50 or the underside of belt 20, or both. Preferably, a coating of suitable wax is applied to the underside of belt 20.

FIGS. 2A, 2B, 3A, 3B, 3C and 4 illustrate the preferred arrangement for supporting the deck 50. Specifically, deck 50 is secured to a lightweight steel deck support structure, indicated generally at 52. The deck support structure 52 includes a pair of laterally spaced longitudinal support members 54 and 56 that in turn are each secured to a set of parallel crossbars 58, 60, 62 and 64. Crossbars 58, 60, 62 and 64 extend transversely from one side of the treadmill 10 to the other. Longitudinal member 54 is attached to each of crossbars 58, 60, 62 and 64 with pins or rivets 66, 68, 70 and 72, respectively; longitudinal member 56 is attached to each of crossbars 58, 60, 62 and 64 with pins or rivets 74, 76, 78 and 80, respectively. In turn, crossbar 60 is attached to frame portions 26 and 26' with fasteners 86 and 88, respectively, and crossbar 62 is attached to frame portions 26 and 26' with fasteners 90 and 92, respectively. Further, crossbars 58, 60, 62 and 64 can be constructed, either by a choice of appropriate material or thickness, to provide additional flex to deck 50.

Deck 50 is also supported by an array of resilient members 100 mounted on crossbars 60 and 62 and at each end by a set of resilient members 102 mounted to crossbars 58 and 64. Through the use of the resilient members 100 and 102, the deck 50 is permitted to flex when stepped upon, resulting in lower impact loads on the user's feet. As shown in FIGS. 3B, two of the resilient members 100 are positioned on each of the crossbars 60 and 62.

As further shown in FIGS. 3A and 3C, each end of deck 50 is secured to two of the resilient members 102. Resilient members 102 provide a downward flex as a load resulting from the impact of a treadmill user's feet on deck 50. Resilient members 102 become compressed as the load is placed on deck 50, with potential energy in the direction opposite the direction of compression being stored in the compressed resilient members 102. Although downward flex of the ends of deck 50 is desired, too much downward flex is undesirable because as the user strides on the treadmill 10, the load is alternatively placed on and taken off of deck 50. As the load is taken off of deck 50, the potential energy stored in the resilient members 102 forces the deck upwards.

To partially control downward flex, resilient members 103 are aligned with and placed underneath resilient members 102. As shown in FIG. 2A. Resilient members 103 tend to bias the deck 50 upwards and to limit downward flex of deck 50, creating a smoother surface for the treadmill user. Further, resilient members 103 may be assembled in a partially compressed position which assists in biasing the deck 50 upwards. Resilient members 103 are preferably of the same construction as resilient members 102.

Figure 14:
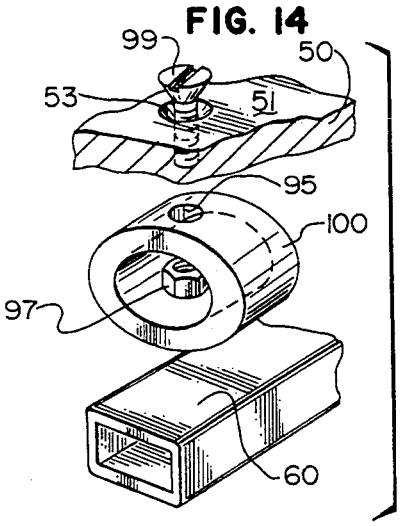
FIG. 14 is a exploded, perspective view of one of the resilient member assemblies shown in FIGS. 2A and 2B.

The resilient members 100 and 102 can be secured to crossbars 58, 60, 62 and 64 by one of a variety of methods. The members 100 are preferably secured to the deck 50 by a flat head, countersunk bolt 105 extending vertically through the top surface 51 of deck 50 and through the bore 95 on the upper portion of the members 100, as illustrated in FIGS. 2A, 2B and 14. A nut 97 on bolt 99 secures members 100 to deck 50. In this embodiment, the lower portion of each member 100 is not connected to the crossbars 60 and 62, thereby permitting the deck 50 to be free-floating relative to the crossbars 60 and 62. The resilient members 102 and 103 connected to the crossbars 58 and 64 can be made of the same material as resilient members 100 and may have a different configuration than members 100, preferably a generally cylindrical or post configuration, with a fastener receiving bore (not shown) substantially aligned along their centerlines for receiving fastener 101. Alternatively, in place of members 100, 102 and 103, springs such as leaf or coil springs or tension bars can be used to perform this support function for deck 50.

Although four resilient members 100 are shown in FIGS. 3B, more or less of the members 100 can be provided. As a general rule, the resiliency of flex of the deck 50 can be reduced by providing more resilient members 100 to support the deck 50. For example, if three sets of two resilient members 100 are provided instead of two sets of two resilient members 100 or by adding another crossbar with two additional resilient members, deck 50 would have slightly less flex during normal operation of the treadmill 10.

The resilient members 100, 102 and 103 can be made from any suitable material, including polystyrene, polycarbonate, polyurethane, polyester, or mixtures thereof, and are preferably made of polyphenylene oxide. TECSPAK® bumpers, made by EFDYN, a division of Autoquip Corporation of Guthrie, Okla., and made of an EFDYN proprietary material including polyurethane and DuPont HYTREL® (polyester elastomers) have been especially useful as resilient members 100, although any other suitable material may be used. In the preferred embodiment, the resilient members 100 have a free, uncompressed height in the range of 1.50 to 3 inches and the hardness of the material is preferably in the range of shore 30A to shore 55A and most preferably shore 47A; the resilient members also have a compressed height in the range of 0.5 to 2 inches. As illustrated in the FIGS. 3B and 14, the members 100 have a generally elliptically shaped configuration, preferably having an uncompressed diameter in the range of about 1.5 to 3.0 inches.

Deck 50 is also preferably assembled into position to be convex or crowned in the longitudinal direction (not shown). Specifically, the front and rear ends of deck 50 are assembled to be lower than the middle portion. Deck 50 is rigidly attached into place first at either the front end or the rear end of the treadmill. Deck 50 is then warped into place and attached to the other end of the treadmill, to have a crown in the middle of deck 50. Deck 50 is provided with a length slightly greater than the distance between the front and rear attachments of deck 50 to crossbars 58 and 64, respectively, so that it can be so assembled. Deck 50 is provided with a crown to provide an additional measure of upward deflection of deck 50 when a load is placed on deck 50 since the load from the feet of the treadmill user is typically placed on the middle portion of the deck 50. Further, the crowning of deck 50 increases its fatigue life because the overall deflection of the deck from the centerline is reduced.

As can be seen from FIG. 2B, 3B and 3C, the rear belt pulley 28 is rotated by a motor 104 during normal operation of the treadmill 10. Motor 104 is mounted to plate 98 by conventional means, plate 98 being mounted to crossbar 62. The rear pulley 28 is rotated by the motor 104 using a toothed drive belt 106 engaged with a complementary toothed sprocket 108 integrally molded on the outer end of body 36. The motor 104 is preferably a variable speed A.C. induction motor having an electrical speed controller. Motor 104 has a toothed sprocket 109 secured to the motor shaft 110. A speed reducing transmission or drive indicated generally at 111 is used to connect pulley 28 to motor 104. By using the speed reducing transmission 111, it is possible to use a smaller, less expensive motor 104. The motor 104 is connected to a reduction pulley 112 by drive belt 113. A toothed sprocket 114 is attached to the same shaft and bearing assembly 115 as gear 112 and engages toothed drive belt 106.

Although the pulley drive arrangement including motor 104 and the speed reducing transmission 111 is shown as being engaged to the rear pulley 28, a similar arrangement can alternatively be used to drive the front belt pulley 22. As discussed below, the speed at which rear pulley 28 is rotated is controlled by microprocessor 300 through motor 104, by varying the voltage and frequency to the electric controller of motor 104. The speed is adjustable from controls on panel 18. With this arrangement, it is therefore possible to vary the belt 20 speed at various times during the exercise routine, such as to perform a predetermined exercise profile.

An idler pulley 116 is also placed intermediate transmission 111 and rear pulley 28 along the upper length of drive belt 106. Idler pulley 116 is supported on axle bracket assembly 117, secured to crossbar 64. Idler pulley 116 eliminates slack from drive belt 106 and allows for better traction between drive belt 106 and rear pulley 28 since a greater circumference of rear pulley 28 is contacted with drive belt 106.

Further, a speed sensor 118, illustrated in FIGS. 2B and 3C, is operatively connected to shaft 115 of transmission 111. Sprocket 119 is similarly notched around its circumference, and is mounted for rotation with shaft 115. The circumference of sprocket 119 is aligned to move through optical reader 120, which measures the number of notches 121 which pass thereby. A pulse for each passing of notch 121 is registered, and a signal is sent to the computer 300. The speed of belt 20 is therefore calculated by the microprocessor from the measurement of the number of pulses per given time period.

Figure 15:
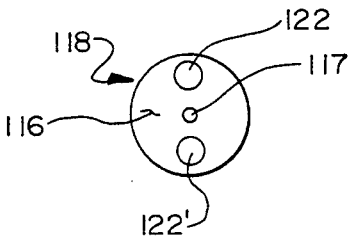
FIG. 15 is a right side view of the idler pulley, illustrating the speed sensor magnets.

An alternative embodiment for speed sensor 118', partially illustrated in FIG. 15, is provided on idler pulley 116 to indirectly measure the speed of the treadmill belt (and consequently the speed of the treadmill user). An end of idler pulley 116 has two magnets 122 and 122' mounted thereon. The magnets 122 and 122' are mounted along a line passing through the center point of that axle on which idler pulley 116 rotates and are positioned equidistant from the center point. The two magnets 122 and 122' are mounted so that during a point of the rotation of idler pulley 116, each becomes aligned with a Hall effect sensor (not shown). Each time either magnet 122 or 122' is aligned with the Hall effect sensor, a pulse is registered from the change in magnetic flux to the Hall effect sensor and a signal is sent to the computer 300. The speed of belt 20 is therefore calculated by the microprocessor from the measurement of the number of pluses per minute. The use of two magnets 122 and 122' at opposite sides of each other on idler pulley 116 allows for more accurate measurement of the speed than if only one magnet were used. Further, the use of the two magnets 122 and 122' allows for the more accurate calculation of acceleration, if desired.

Another alternative embodiment for speed control not shown in the drawing would use an induction motor controller which delivers a fixed speed for a given control signal i.e., treadmill computer 300 sends a given number of pulses (which equates to a pre-determined speed) to the motor controller. In turn, the motor controller will maintain this motor speed within an acceptable tolerance limit. This system is referred to as an open loop system.

Although the pulley drive arrangement including motor 104 and the mechanical transmission 111 is shown as being engaged to the rear pulley 28, a similar arrangement can alternatively be used to drive the front pulley 22. However, the use of motor 104 to drive the rear pulley 28, and the mounting of motor 104 intermediate the front pulley 22 and rear pulley 28 within treadmill enclosure portions 12 and 12' accrues several novel advantages. Known designs of treadmills have not placed the drive motor intermediate the front and rear pulleys because the size of the drive motor was too large to be placed intermediate the smaller sized pulleys. Previously known arrangements housed the drive motors in an appendage enclosure of generally greater height than the rest of the treadmill enclosure to accommodate the motor size. Placement of the motor 104 as illustrated eliminates the need for an appendage enclosure of greater height.

Further, a slack portion on the belt 20 is eliminated by a rear pulley drive arrangement compared to a front pulley drive arrangement. Specifically, with a front pulley drive arrangement, a slack portion would tend to develop on the upper or running length of the belt since the front pulley was pulling the bottom surface of the belt towards the front of the treadmill. The slack portion would tend to increase wear of the belt. With the rear pulley drive arrangement, the same effect of the pulley is seen but with the slack portion appearing on the bottom length of belt and the upper length at the belt being relatively taut. The treadmill user is therefore not stepping on a relatively slack section of belt 20, which increases fatigue life and increases smooth operation of treadmill 10.

Returning to the description of the support mechanism for deck 50 as shown in FIGS. 2A–B, the back portion of deck 50 is attached to crossbar 64 with an angle iron 123. Angle iron 123 is secured to crossbar 64, and is also attached between resilient members 102 and 103 by fasteners 101. Second angle iron 124 extends between resilient members 102 supporting the back portions of deck 50, and is positioned between the top of resilient members 102 and deck 50.

At the front end of deck 50, third angle iron 132 rests between the resilient members 102 and 103 and is secured to the crossbar 58. Fourth angle iron 130 extends between resilient members 102 and is also attached to resilient members 102 and 103 by fasteners 101. Fourth angle iron 130 is positioned between the top of resilient members 102 and deck 50. In turn, the fourth angle iron 130 is also attached to crossbar 58 through linkage assemblies indicated generally at 134 and 136. Further, members 54 and 56 are attached to fourth angle iron 130 by pins or rivets 128, as shown in FIG. 3A.

The linkage assemblies 134 and 136 include blocks 138 and 140, respectively, that are attached to fourth angle iron 130 by any suitable means. Blocks 138 and 140 are cooperatively attached to stationary blocks 142 and 144 through a pair of links 146 and 148, respectively. Stationary blocks 142 and 144 are attached to the crossbar 56. When weight is placed on deck 50, the front portion of deck 50 will flex downward under the weight. The links 146 and 148 allow the deck 50 to flex downwardly and in a forward direction. Blocks 138 and 140 also move downwardly and slightly forward, while stationary blocks 142 and 144 remain stationary. The purpose of the linkage assemblies 134 and 136 is to provide additional flexure and to permit forward movement of the deck 50 during operation of the treadmill.

A simpler, preferred method for allowing deck flexure and movement is illustrated in the partial cross-section of FIG. 2C. In FIG. 2C, each linkage and block assembly just described is replaced by a single rubber or elastomeric member 400 mounted between the deck 50 and frame crossmember 402 which is affixed to the treadmill frame portions 26 and 26' (not shown). Member 400 includes an elastomeric body 404 having a generally upright cylindrical shape. Member 400 also includes a threaded metal insert 406 for receiving a countersunk mounting screw 408 used to fasten deck 50 to member 400. Member 400 also includes a threaded member 410 protruding axially from the bottom of member 400. The threaded member 410 is used to secure member 400 to crossmember 402. Member 410 can be attached to the crossmember 402 by inserting it into a threaded aperture 412 in the member 402 or by inserting it through a non-threaded aperture and securing it with a nut (not shown). A suitable elastomeric member 400 is produced by the Lord Company of Erie, Pa., Part No. J-11729-177.

Member 400 is preferred because it is mechanically simpler than the linkage system already described. Additionally, member 400 permits deck movement in both the lateral and longitudinal horizontal directions while limiting vertical movement.

Figure 4:
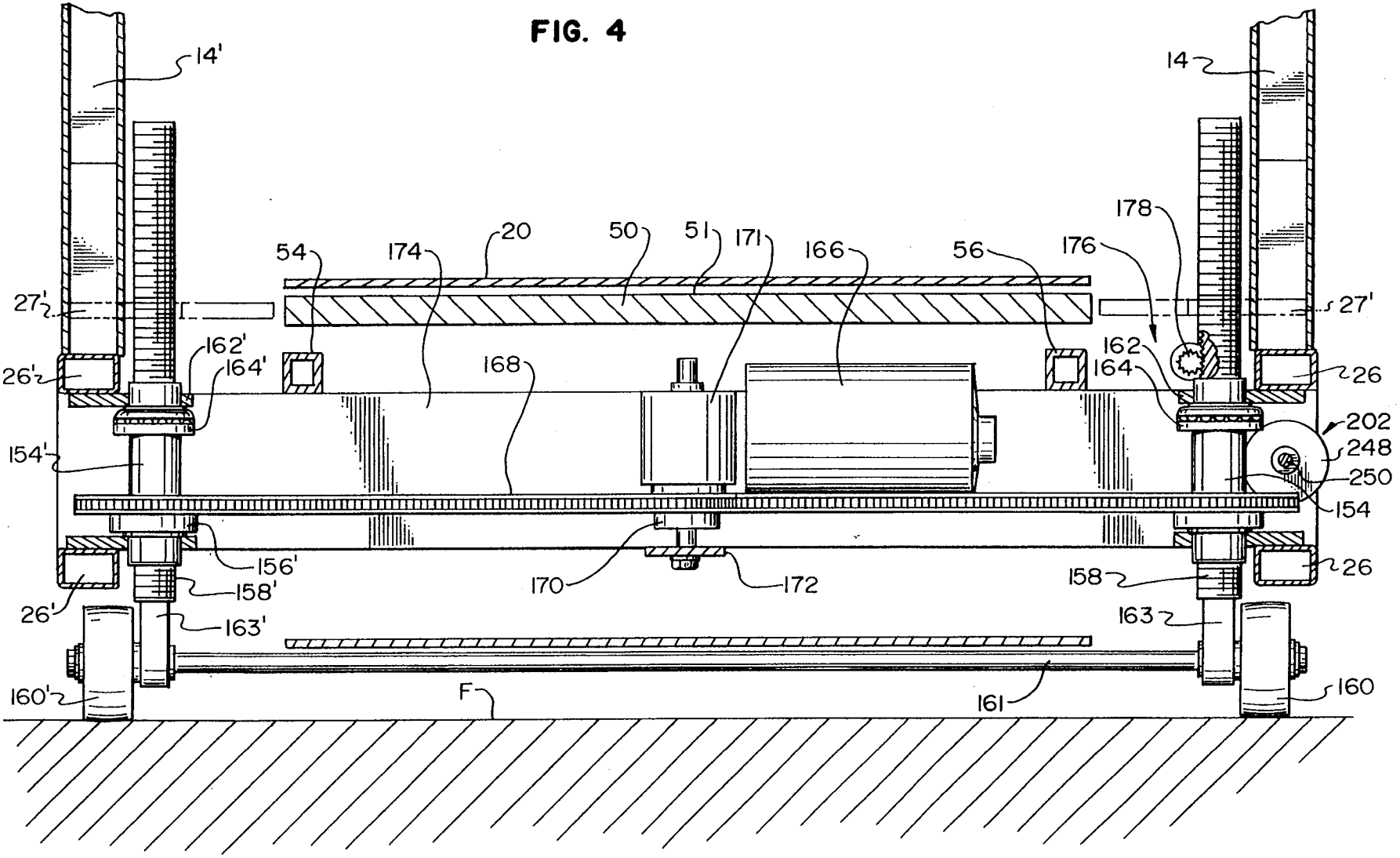
FIG. 4 is a sectioned front view of the exercise treadmill of FIG. 1, illustrating the internal lift assembly of FIG. 3A.

As illustrated in the Figures generally, and in particular FIGS. 2A, 3A and 4, a lift or inclination mechanism indicated generally at 150 for the treadmill 10 is provided to permit inclination of the deck 50. Lift mechanism portions 152 and 152' are similarly constructed with like reference numerals referring to like parts. In FIG. 2A, lift mechanism 152 includes an internally threaded sleeve 154 welded or otherwise permanently attached to a sprocket 156. When sprocket 156 is rotated, the sleeve 154 will travel upward or downward depending on its direction of rotation on a non-rotating, threaded screw or post 158. The screw 158 is in effect forced downward against the floor F resulting in the raising of the front portion of treadmill 10 when, for example, the sprockets 156 are rotated in a first direction. As illustrated in FIG. 3A, screw 158 extends upwardly through enclosure 12. Shroud 159 conceals the screw 158 from the user for safety and aesthetic reasons. Shroud 159 is attached at its lower end to enclosure 12 and at its upper end and or at its sides to side post 14.

Rollers 160 and 160' can also be rotatably attached to the lower end of non-rotating screws 158 and 158', respectively. As the roller 160 is forced downward against the floor F, the treadmill 10 will roll slightly to compensate for the inclination of the treadmill 10. The inclination of treadmill 10 is thereby facilitated by this slight movement of roller 160. Rollers 160 and 160' are rotatably secured together on axle assembly 161, with axle assembly 161 being secured to posts 158 and 158' by brackets 163 and 163', respectively.

Because the frame 26 is attached through a bracket 162 and bearing assembly 164 to sleeves 154, as sleeves 154 are rotated downwardly on the screw 158, the frame 26 will incline in an upward direction. The lift mechanisms 152 and 152' are located substantially opposite each other on either sides of the treadmill 10. Both lift mechanisms 152 and 152' are operatively connected to an inclination motor 166. Sprockets 156 and 156' are attached to sleeves 154 and 154' at the same height so that a chain 168 can both be operatively connected to the motor 166 by a sprocket 170. Chain 168 is formed in a serpentine arrangement on sprockets 156 and 156', motor sprocket 170 and guide sprocket 171. The motor 166 is mounted on a base plate 172, which extends between crossbar 58 and mounting plate 174. Mounting plate 174 itself extends between frame portions 26 and 26'. By this arrangement, the motion upward or downward on both non-rotating screws 158 and 158' will be the same, and as a result both sides of the treadmill 10 will be inclined to the same degree.

Any suitable inclination can be achieved by lift mechanisms 152 and 152', preferably in the range of zero to eighteen percent. As discussed below, the degree of inclination desired by the treadmill user may be controlled within the predetermined range by controls on panel 18.

The degree of inclination chosen by the treadmill user is further controlled by a potentiometer 176 connected to microprocessor 300. Potentiometer 176 is attached to frame 26. Potentiometer 176 also comprises a gear 178 which is mounted to travel up or down screw 158 as treadmill 10 becomes more or less inclined, respectively. The rotation of gear 178 therefore is used to calculate the degree of inclination as discussed below. Additionally, limit switches (not shown) which sense the upper and lower degrees of inclination, respectively in a known arrangement. The limit switches are mounted to screw 158 which are activatable by sleeves 154 respectively when the sleeves move into contact therewith. The limit switches are therefore a redundant inclination sensing device to potentiometer 176. Once the maximum upper or lower degree of inclination is reached as sensed by either potentiometer 176 or the limit switches, the microprocessor shuts off motor 166.

FIG. 3D illustrates a preferred embodiment of the lift mechanism just discussed. In FIG. 3D, the chain 168 of FIG. 3A has been replaced by a toothed belt 420. The toothed belt 420 drives a pair of molded pulleys 422, each of which integrally includes a plurality of teeth 424 and an internally threaded sleeve 426. Belt 420 rotates around pulleys 422, an idler pulley 430 and is driven by a drive pulley 428. Pulleys 428 and 430 are generally equivalent to sprockets 170 and 171 of FIG. 3A but are, of course, designed for operation with a toothed belt instead of a chain.

The operation of the preferred lift mechanism is similar to that already discussed in conjunction with FIG. 3A except that the mechanism is designed for a 0 to 15 percent grade range. The molded pulleys and belt provide for quieter lift mechanism operation and eliminate the need for lubrication of the chain 168 shown in FIG. 3A.

Another method for controlling the inclination of treadmill 10 is through the use of time. This method eliminates the need for potentiometer 176. In this method, lift motor 166 will raise the treadmill to the maximum height limit switch (not shown) when the treadmill is first energized. Then, the motor is reversed to go to its lowest position where a logic switch (not shown) is activated. The time it takes for lift mechanism 152 to go from high to low is divided into 15 equal parts and stored in non-volatile memory. Each division is equal to a 1% incline. This procedure is known as calibration. Once calibrated, percent elevation is controlled by treadmill computer 300 in units of motor lift time.

Figure 7:
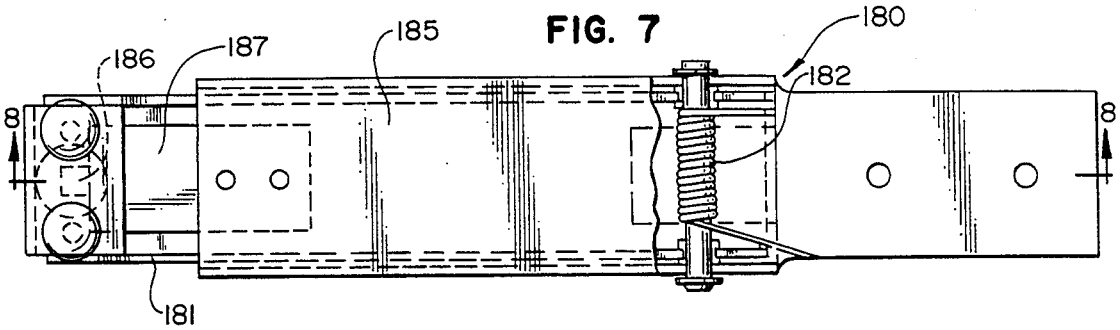
FIG. 7 is a top view of an impact sensor for use with the treadmill of FIG. 1.
Figure 8:
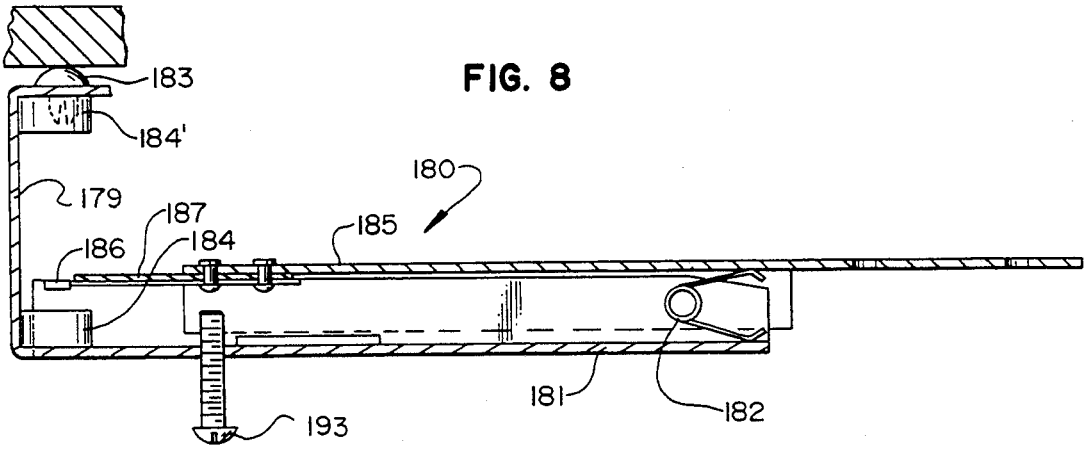
FIG. 8 is a side view of the impact sensor of FIG. 7.

An impact sensing mechanism 180, illustrated in FIGS. 7 and 8, is used to provide a measurement of the relative impact force of the user's feet on deck 50. Impact sensor 180 is preferable provided at or near the midpoint of deck 50 and is mounted substantially horizontally on crossbar 62 and includes a deflection arm 181 which is resiliently biased by spring 182 against the lower surface of the deck 50. A pair of rubber or plastic elements 183 are mounted on the end of the arm 181 in contact with the lower surface of the deck 50. By this arrangement, as the deck 50 flexes downwardly when the user's feet impact the deck, the arm 181 will also be deflected downwardly. The arm 181 is configured with a U-shaped portion 179 which contains a pair of magnets 184 and 184'. As shown in FIG. 8, the magnets 184 and 184' are mounted in a substantially vertical array on opposite sides of the U-shaped portion 179.

The impact sensor 180 also includes a cantilevered sensor support member 185 that is rigidly secured to crossbar 62. Mounted on the free end of the support member 185 is a Hall effect sensor element 186 which is used to detect the position of the free end of the arm 181 relative to the stationary sensor support member 185. As shown in FIG. 8, the Hall sensor element 186 is positioned substantially along the same vertical line as the magnets 184 and 184'. The Hall effect sensor element 186 is effective to detect changes in magnetic flux generated by magnets 184 and 184' and translates these changes into an electrical signal. Therefore, when the deck 50 (and consequently arm 181) flexes downwardly, the position of the sensor element 186 relative to magnets 184 and 184' will change and an analog electrical signal is generated by the sensor element 186 that represents the deflection of the deck 50. Also attached to the sensor support member 185 is a printed circuit board 187 that contains various electronic circuit elements which are effective to transmit a filtered version of the Hall effect sensor signal to the computer 300 where a resident analog to digital converter converts the analog signal into a digital signal that represents the deflection of the deck 50. In the preferred embodiment of the invention, this digital deflection signal is sampled every 5 milliseconds and the value is stored in the memory of the computer 300. Once, each 1.5 second period the maximum value of the digital deflection signals stored in memory is identified by the computer 300 and used to calculate the impact force.

Figure 9:
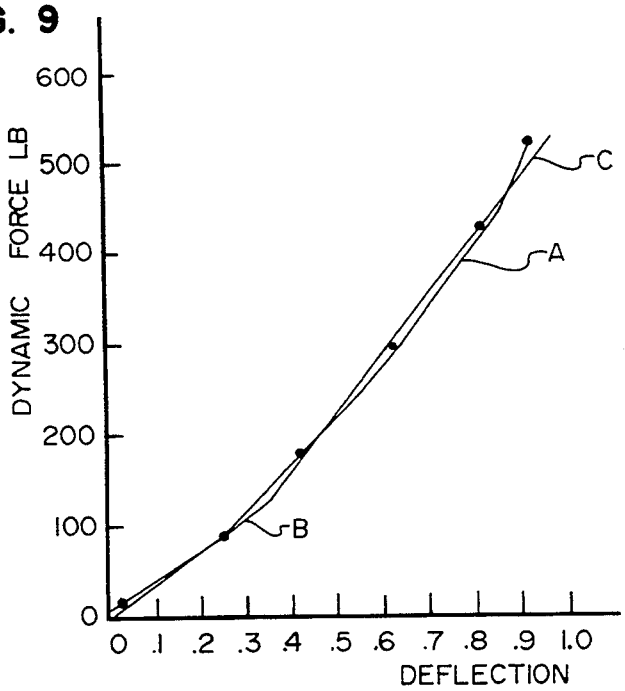
FIG. 9 is a graph of dynamic force versus downward deflection of the deck.
Figure 10:
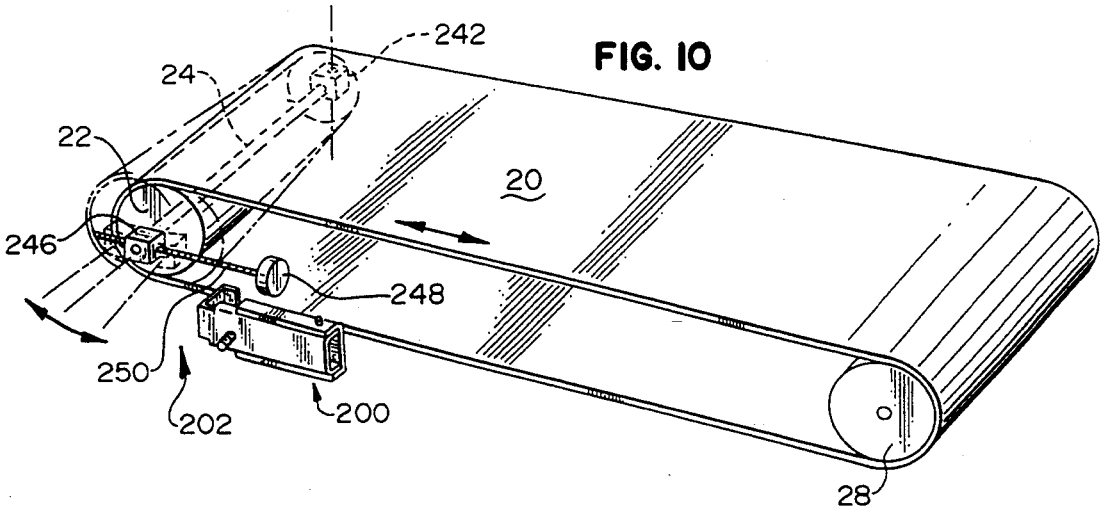
FIG. 10 is a perspective view illustrating the placement of a belt sensing mechanism and a front pulley pivoting mechanism.

In particular, the computer 300 uses the maximum deflection value to calculate the impact force by comparing the measured deflection with corresponding force values, such as set forth in FIG. 9. FIG. 9 has along its X-axis values representing the deflections of the deck 50 in inches and, along the Y-axis, corresponding impact force values in pounds. These impact force values can be derived by calculating the force required to compress the resilient members 100 in combination with the force required to deflect the deck member 50. Alternatively, these force/deflection values may be determined empirically.

Computation of the impact force by the computer 300 can be simplified by forming linear approximations of the curve "A" shown in FIG. 9 and using linear equations to calculate the impact force for each deflection value. As an example, the curve in FIG. 9 can be approximated by the following linear equations: for 0.0 to 0.4 inch deflections, $y=400x$ (illustrated as line "B"); and for 0.4 to 0.9 inch deflections, $y=640x-96$ (illustrated as line "C").

Once the impact force value is calculated by the computer 300, normalized impact force value based on the user's weight can be calculated. Specifically, before or during use of the treadmill, the user enters his weight via the control panel 18 into the memory of the computer 300. The impact force value is then divided by the user's weight by the micro-processor 300 to yield a normalized or relative impact force value.

Figures 16, 17:
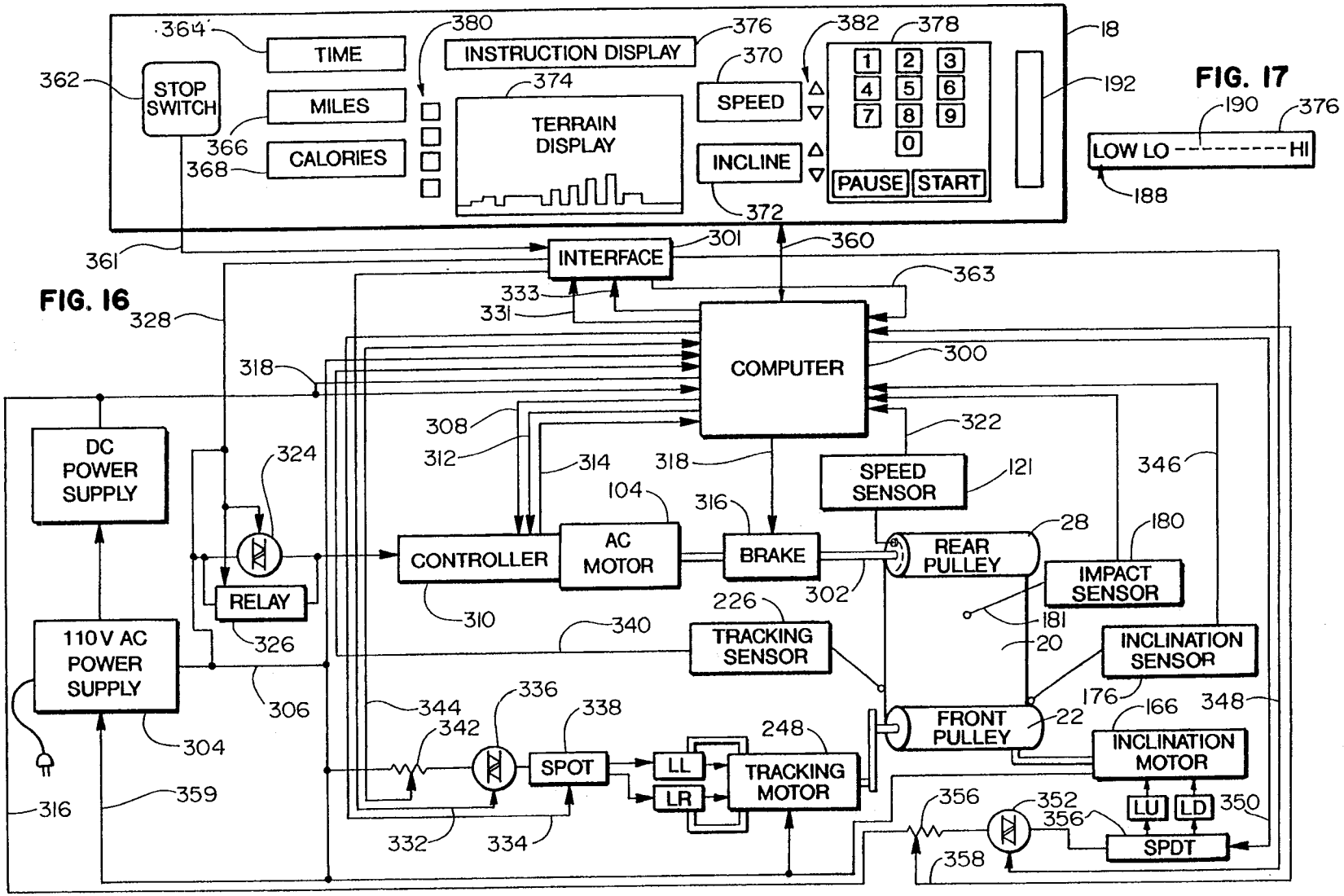
FIG. 16 is a functional block diagram illustrating the integrated control scheme.
FIG. 17 is a diagram illustrating the impact force display.

In one embodiment of the invention, the resulting relative impact force value is displayed graphically to the user on the vacuum fluorescent display 376 of FIG. 16. Two examples of the use of display 376 to display relative impact force values are illustrated in FIG. 17. In the upper example of the display 376 in FIG. 17, the left hand portion indicated at 188 is used to display the word "LOW," and the right hand portion indicated at 189 is used to display the word "MED" with a 14-segment bar graph 190 generated between the illuminated words "LOW" and "MED." The greater the relative impact force value, the more segments 190 are illuminated. In the preferred embodiment, the display in FIG. 17 is autoscaled by the computer 300 into two ranges so that when the relative impact force is between 0.8 and 1.75, "LOW" and "MED" are displayed, and when the relative impact force is between 1.75 and 3.0, the words "MED" and "HI" are displayed at the left hand portion 188' and at the right hand portion 189' of display 376 as shown in the lower example of FIG. 17. As the relative impact force in each range increases, the number of illuminated segments 190 are increased from left to right. In this embodiment, the relative impact force is displayed on the display 376 only during the actual operation of the treadmill 10 after operating instructions have been displayed; the user has entered his weight and selected an exercise program and the speed of the belt 20 has reached 4.0 miles per hour.

As an alternative, the user can be provided with a graphical display of relative impact force by a vertical column of, preferably, ten LEDs 192 as shown on the panel 18 of FIG. 16. The autoscaled range effect can be simulated by using tri-colored LEDs where for example green would indicate the low scale, yellow would indicate the medium scale and red would indicate the high impact scale. Corresponding to the previously described vacuum fluorescent display 376, the individual LED segments in the display 192 would be illuminated from bottom to top as the relative impact force increased within each scale.

Calibrating the impact sensor is accomplished in the preferred embodiment as shown in FIG. 8 by utilizing a calibration screw 193 which is threaded into the arm 181. The end of the screw 193 abuts the sensor support member 185 and calibration is accomplished by rotating the screw sufficiently to move the arm 181 downwardly in 0.125 inch increments. The digital value of the signal from the Hall effect sensor 186 is recorded in a table in the memory of the computer 300 for each 0.125 inch increment. This table is then used by the computer 300 to determine from the digital deflection signals the actual deflection of the deck 50.

A belt position sensing mechanism such as 200 or 200' as shown in FIGS. 10–13 can be used to provide for positive lateral tracking of the belt. As a result, the belt is prevented from laterally sliding too far to one side of the pulley so that it contacts a frame member or other portions of the structure, resulting in increased belt wear or damage to the belt. This arrangement also decreases the sensitivity of the belt to improper adjustment and side loading for which the lateral position of the belt is corrected. The belt position sensing mechanism 200 or 200' senses the position of the belt and causes a front pulley pivoting mechanism indicated at 202 to move the belt back into proper position.

The belt position sensing mechanism 200 or 200' is capable of sensing whether the belt 20 has laterally moved too far to either the right or the left, or whether the belt 20 is positioned within a proper range of positions for normal operation. The belt position is measured by the position of one lateral edge of the belt, the same edge being used to measure the left and right lateral movement of the belt 20. If the belt 20 has moved too far to the left so that the edge of the belt is out of the proper range, the belt is laterally moved to the right towards and into the proper range by the mechanism 202. Similarly, if the belt 20 has moved too far to the right so that the edge of the belt is out of the proper range, the belt 20 is laterally moved to the left towards and into the proper range.

Figure 11:
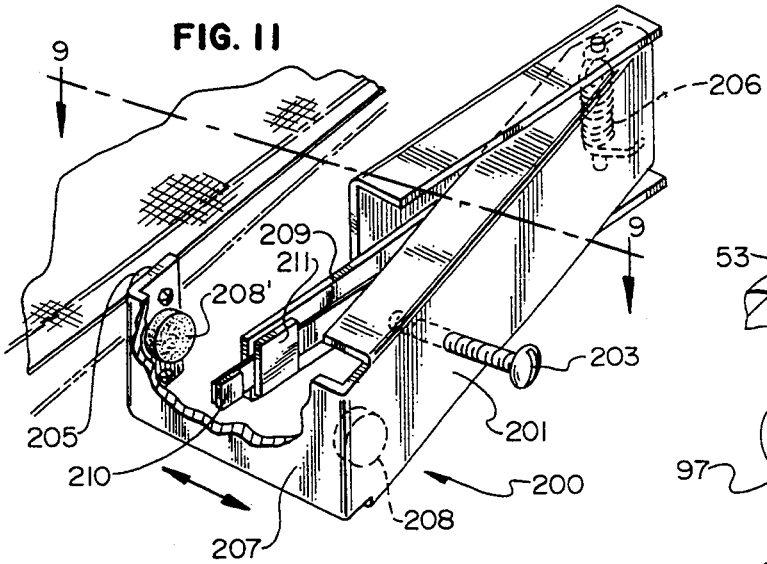
FIG. 11 is a perspective view of the belt sensing mechanism of FIG. 10.
Figure 12:
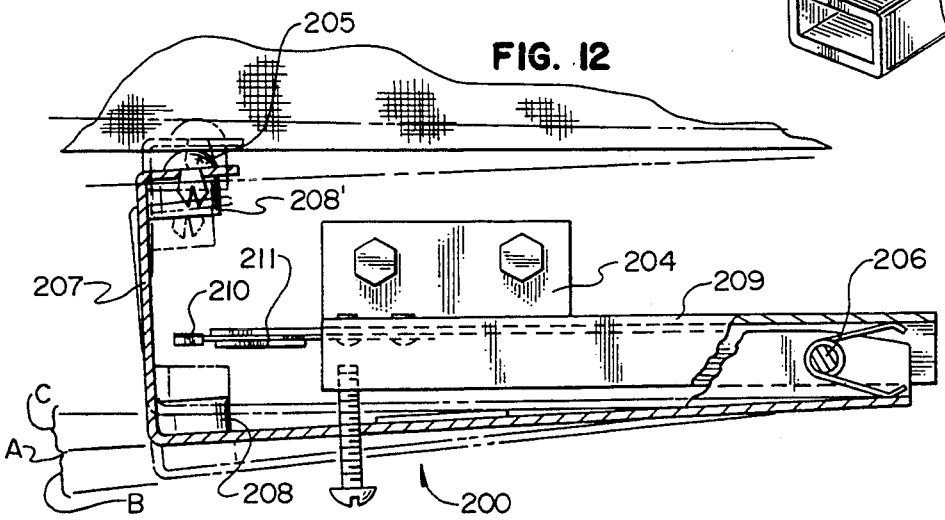
FIG. 12 is a top view of the pivoting movement of the sensor arm of the belt sensing mechanism in FIG. 11.

The preferred embodiment of the belt position sensing mechanism 200 is illustrated in FIGS. 11–12, and can be located along an edge of the upper or lower surface of belt 20. Preferably, the belt sensing mechanism 200 or 200' is located along an edge of the lower run of belt 20, and is preferably mounted on the left, lower front portion of the belt 20.

Belt position sensing mechanism 200 is mounted on a bracket 204 which is attached to the frame portion 26. Belt sensing mechanism 200 of FIG. 11 is similar in design and operation to the impact sensing mechanism 180 of FIGS. 7 and 8 discussed above. Belt sensing mechanism 200 is calibrated with screw 203, as described above in connection with impact sensing mechanism 180.

The sensing mechanism 200 includes a sensor arm 201 with a rubber or plastic element 205 biased towards belt 20 by a torsion spring 206. Alternatively, a pin or coil spring (not shown) could be used in place of element 205. The pin or spring would extend vertically downward and be resiliently biased towards belt 20. With this arrangement, the element 205, and hence the arm 201, will effectively track the belt 20 as it moves from side to side. The use of a coil spring in place of a rigid finger, arm or pin is to prevent damage during handling or transit of the treadmill. Experience has indicated that rigid members bend when subjected to abuse, rendering the sensor 200 inoperable. The coil spring deflects when loaded, and when the load is released, the spring returns to its normal position.

The sensor arm 201 includes a U-shaped portion 207 containing a pair of magnets 208 and 208'. As shown in FIG. 11, the magnets 208 and 208' are mounted in a substantially horizontal array at opposite ends of the U-shaped portion 207.

The sensing mechanism 200 has a sensor support member 209 which is rigidly mounted to bracket 204, and which is stationary with respect to the sensor arm 201. At the free end of member 209, a Hall effect sensor 210 is positioned substantially in alignment with the magnets 208 and 208'. As is conventional, sensor 210 detects changes in magnetic flux generated by the magnets 208 and 208' and translates these changes into an electrical signal. Therefore, when the belt 20 (and consequently sensor arm 201) is within the proper range, a predetermined electrical signal is generated by sensor 210. As belt 20 (and consequently sensor arm 201) moves out of the proper range, the magnetic flux changes as sensor 210 moves relative to the magnets 208 and 208', producing different electrical signals. Sensor 210 is connected to microprocessor 300 via a printed circuit board 211 which serves to condition the position signals generated by the Hall effect sensor 210. As will be described below, the signals from the sensor 210 can be used by the pivoting mechanism 202 to keep the belt 20 within a desired range.

As discussed above, if the belt 20 moves either to the left or right, sensor arm 201 travels with the belt 20. The movement of sensor arm 201 can be divided into three ranges, illustrated with respect to the alternative embodiment in FIG. 12. Specifically, there is a range of movement in FIG. 12, that is "proper," labelled as range "a", and no correction is necessary. If sensor arm 201 moves either left, labelled as range "b", or right, labelled as range "c", out of the proper range, correction of the lateral position of the belt is necessary.

Figure 12A:
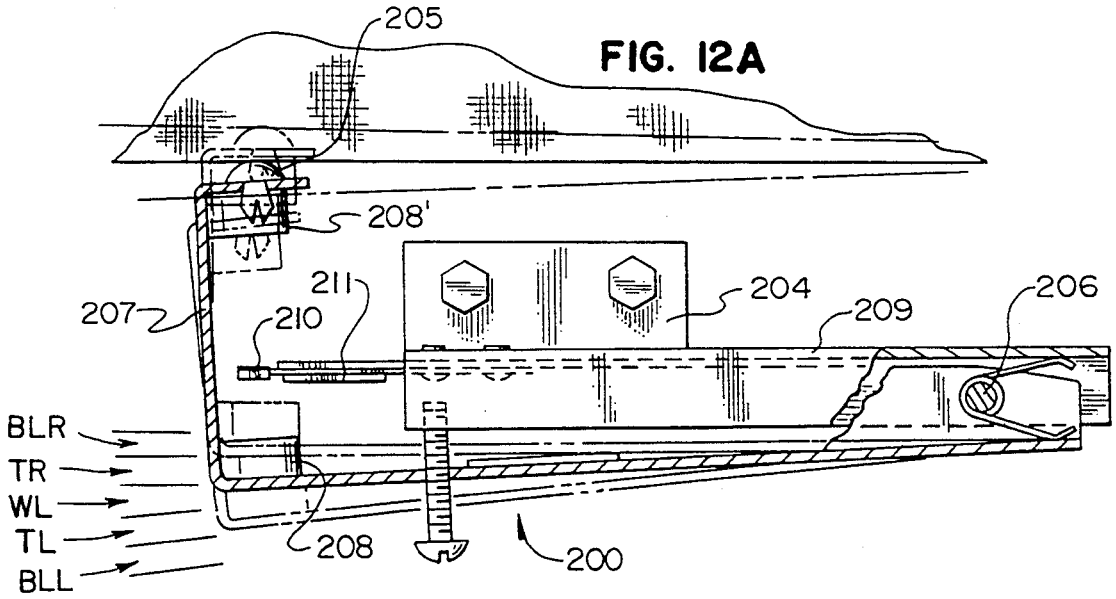
FIG. 12A is a top view of the pivoting of the sensor arm of FIG. 12 showing the preferred sensing regions.

Lateral tracking of belt 20 can be improved by dividing the range of travel of sensor arm 201 into five regions as indicated on FIG. 12A. These regions correspond to belt "within limit" conditions as indicated by the region labelled WL, minor deviations of belt travel left or right as indicated by the regions labelled TL and TR, respectively, and major "beyond limit" deviations of belt travel left or right as indicated by the regions labelled BLL and BLR, respectively. Positional information provided from these five sensing regions can be used in conjunction with an indication of belt speed to provide optimal belt tracking correction as a function of speed and position by varying the duty cycle of tracking motor 248. In such a control regime, the duty cycle of the motor 248 should increase with greater belt speed and greater deviation from the ideal path of travel.

One example of the preferred tracking scheme linearly increases tracking motor duty cycle with increasing belt speed. For example, consider belt speeds of 1.5, 4 and 7 miles per hour. When belt speed is in the 1.5 mile per hour range, a 15 percent motor duty cycle is used to correct tracking deviations in the TL or TR regions. When tracking deviations enter the BLL or BLR regions, the duty cycle is increased to 30 percent. Four mile per hour corrections employ a 22 percent duty cycle when deviations are in the TL or TR regions and a 57 percent duty cycle when deviations are in the BLL or BLR regions. Seven mile per hour corrections employ a 50 percent duty cycle when deviations are in the TL or TR regions and a 90 percent duty cycle when deviations are in the BLL or BLR regions.

In each case, the motor is turned on for one second, followed by an off period of the appropriate length to yield the required duty cycle. Within regions WL, TL and TR, the belt position is sensed every second and corrections initiated if required. When the belt position is in the BLL or BLR region, sensing and correction is performed only at the end of the "off" period of each cycle. Preferably, the motor 248 remains switched off following belt movement from BLL or BLR to TL or TR to permit the belt 20 to recover from the more severe belt adjustment just performed.

Figure 12B:
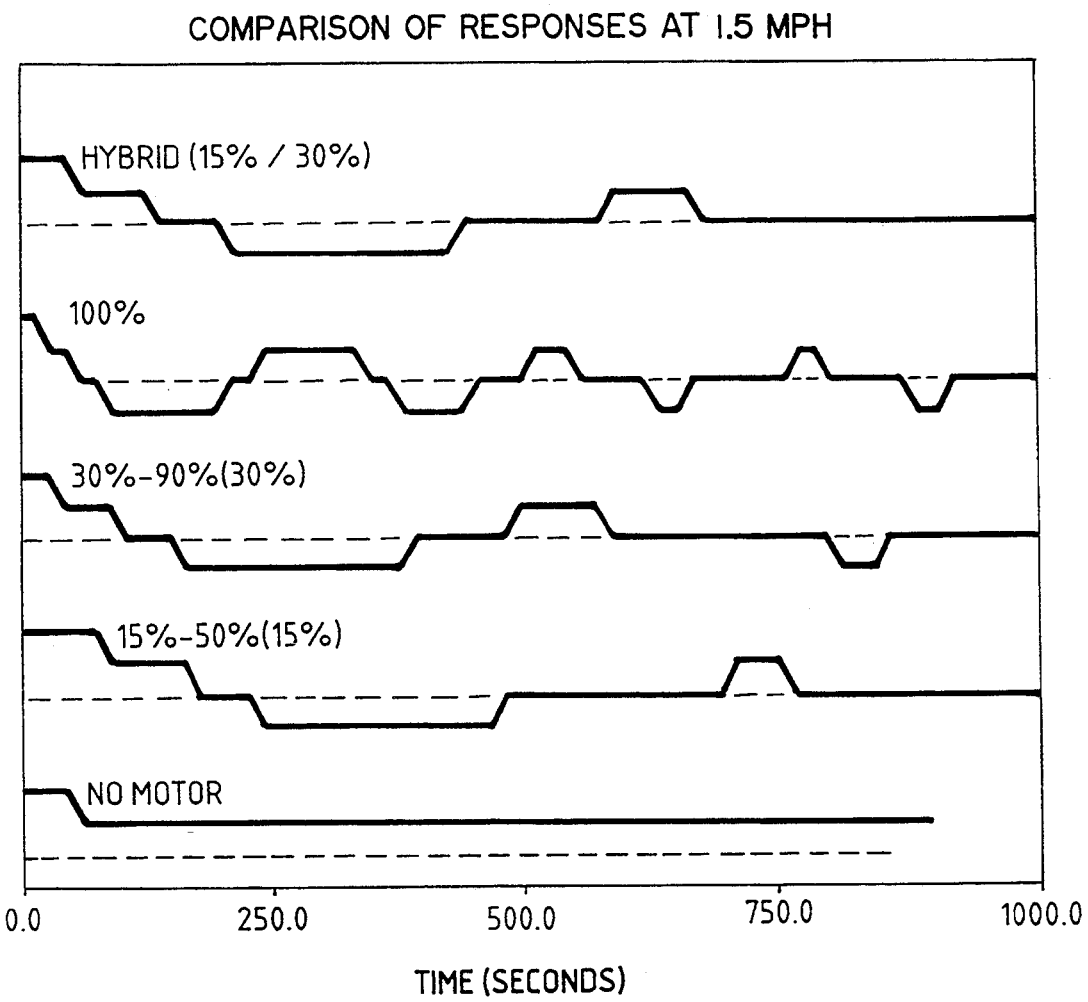
FIGS. 12B–12D are graphs of belt tracking performance at 1.5, 4 and 7 miles per hour using different belt tracking motor control regimes.
Figure 12C:
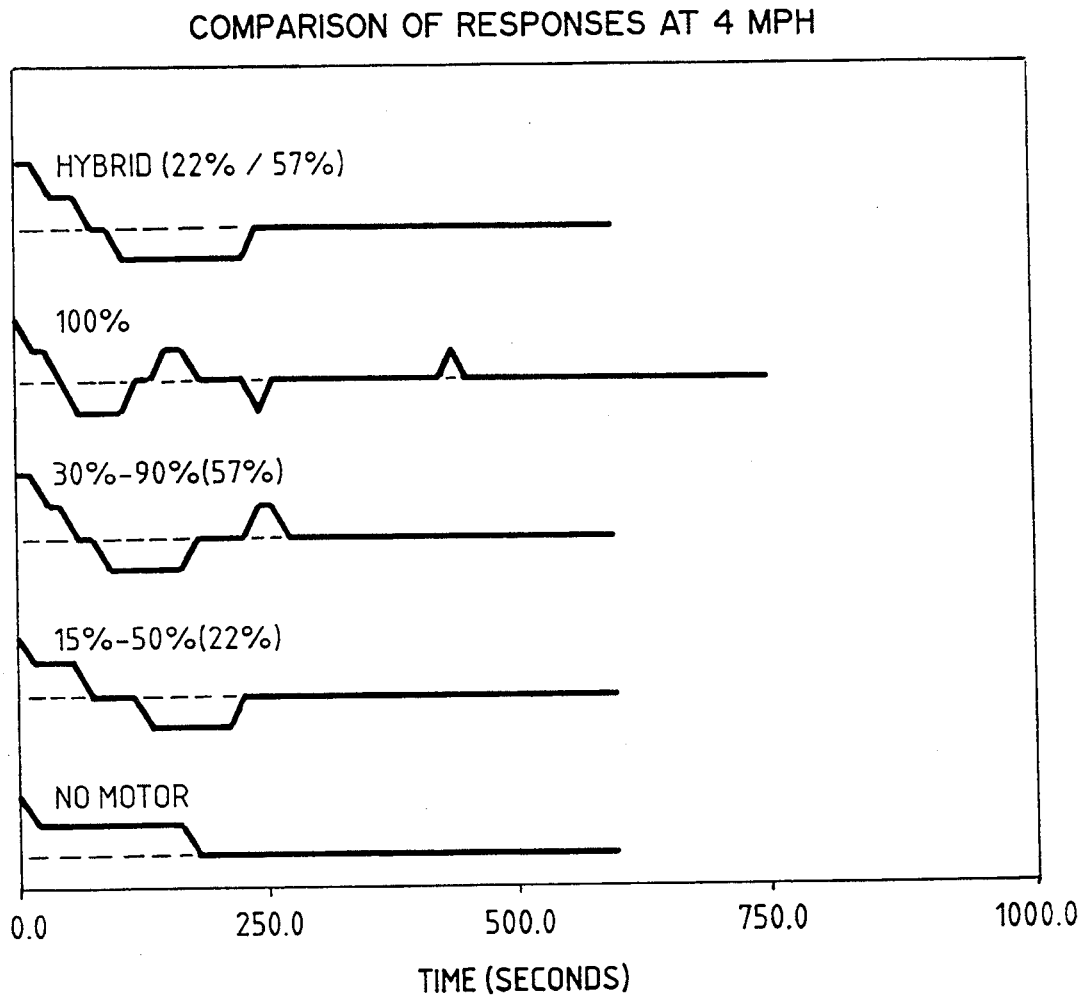
Figure 12D:
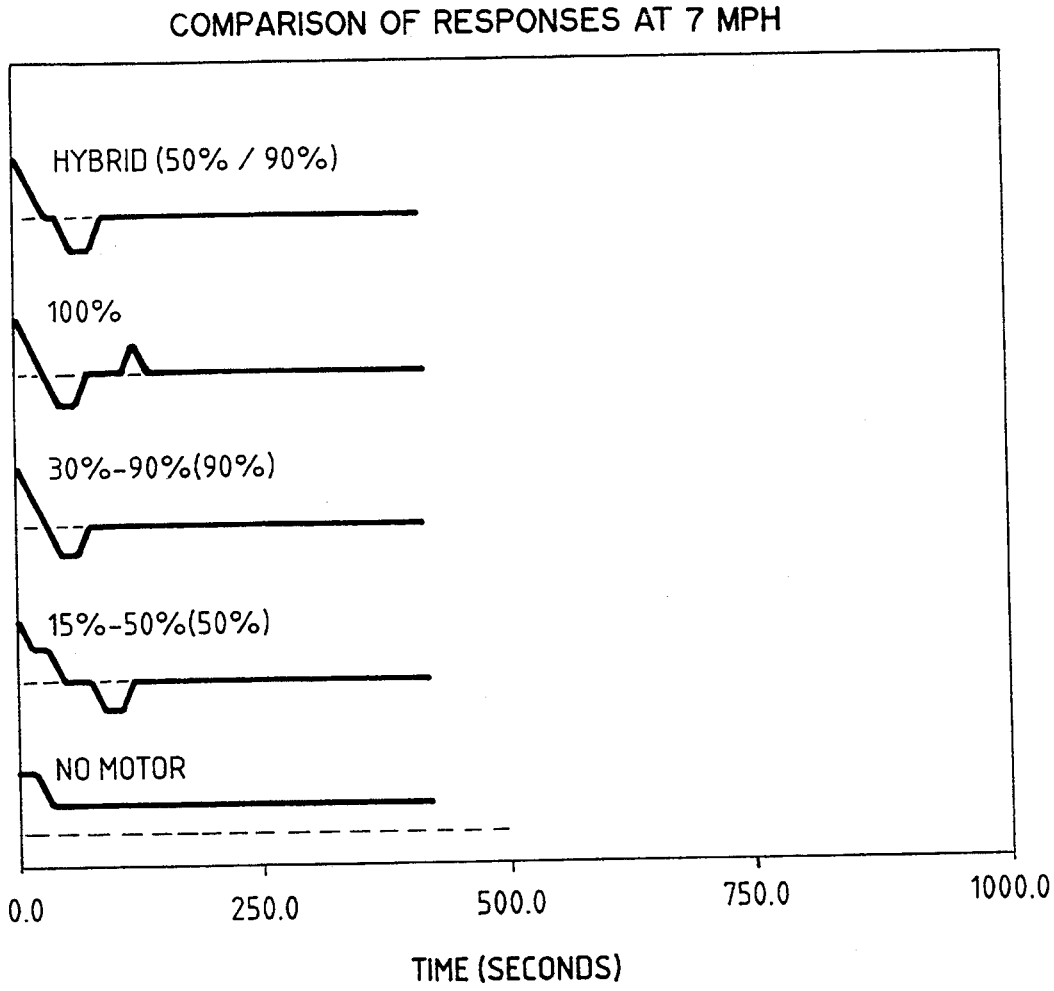

The effects of a variable duty cycle tracking regime operating at 1.5, 4 and 7 miles per hour are illustrated in FIGS. 12B–12D. In FIGS. 12B–12D, the horizontal dashed axes represent ideal belt tracking, while the solid lines represent the belt position resulting from attempted tracking corrections made in response to an initial "beyond limits" perturbation. The available motor duty cycles for tracking motor 248 are indicated in parentheses. In each case, it can be seen that the optimized multiple duty cycle control region described in the preceding paragraph reaches optimal tracking as fast or faster than single duty cycle or non-optimized multiple duty cycle control regions and that, in many cases, the optimized multiple duty cycle regime reduces control "overshoot" problems. Other embodiments may employ a greater number of sensing regions and/or duty cycles to obtain even "smoother" control characteristics. These multiple duty cycle control regimes are also suitable for use with the alternative embodiment of the position sensor described below.

Figure 13:
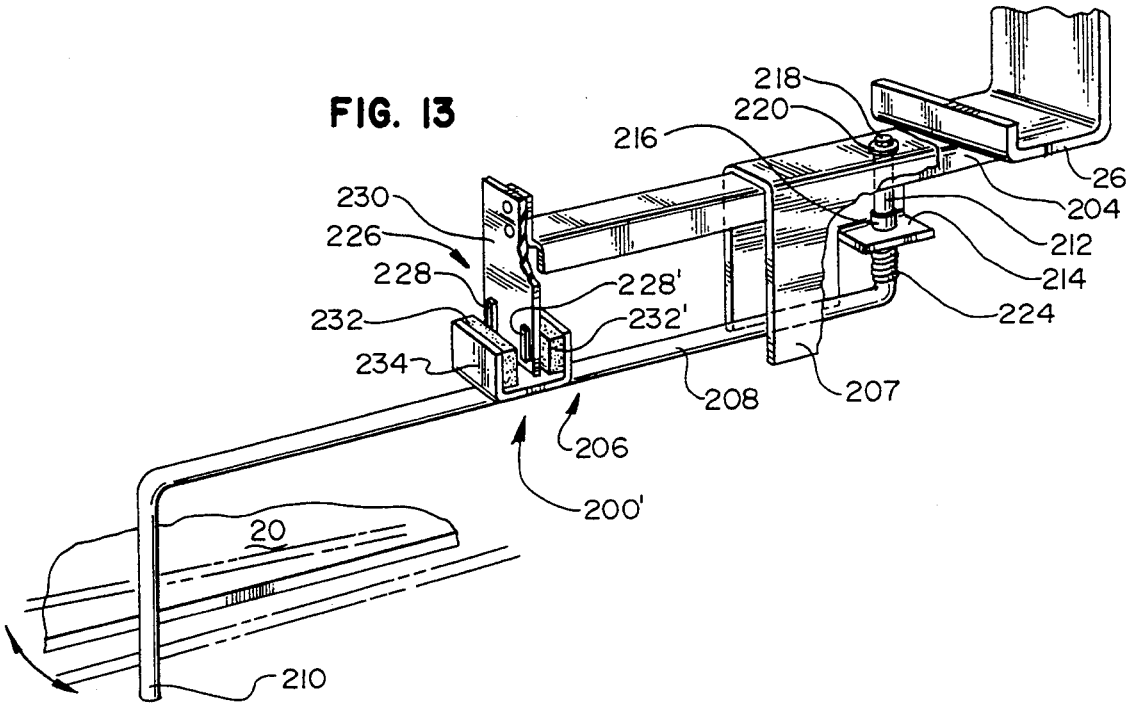
FIG. 13 is a perspective view of an alternative embodiment for the belt sensing mechanism.

In an alternative embodiment, illustrated in FIG. 13, sensing mechanism 200' has sensor arm 215 with an elongated portion 217, a vertically downward extending leg 219 attached to one end of elongated portion 217 and a vertically upwardly extending leg 212 attached to the opposite end of elongated portion 217. Sensor arm 215 is substantially cylindrical at all portions. As seen in FIG. 13, upward leg 212 is mounted for rotation on beam 213. Beam 213 is secured to the frame portion 26. Upward leg 212 extends through bushing 214, having a cylindrical sleeve 216 therethrough. Cap 218 and washer 220 are connected to the uppermost end of upward leg 212, with cap 218 partially extending into sleeve 216. A torsion spring 224 is chosen of sufficient length so that it is partially compressed between the bottom of bushing 214 and the bend between upward leg 212 and elongated portion 217. Sensor arm 215 is therefore biased towards belt 20 by torsion spring 224, and downward leg 219 contacts and is biased against belt 20. By this arrangement, when belt 20 moves to the right, downward leg 219 is still biased against belt 20, and when belt 20 moves to the left, downward leg 219 is pushed outward against the torsion spring 224.

The detection of whether the sensor arm 215 has moved out of the proper range is accomplished by a dual Hall effect sensor 226. Hall effect sensor 226 is used to detect the position of sensor arm 215 by using dual sensors 228 and 228′ connected to a printed circuit board 230. Printed circuit board 230 is directly mounted on the crossmember 213 and sensors 228 and 228′ are attached to the lower end of board 230. Sensors 228 and 228′ are positioned to be aligned substantially along the same horizontal line on board 230. Magnets 232 and 232′ are held in cup 234 placed on sensor arm 215 and are positioned on opposite sides of sensors 228 and 228′. As is conventional, sensors 228 and 228′ detect changes in magnetic flux around them and translate these changes into changes in electrical current. Therefore, when the belt 20 (and consequently sensor arm 215) is within the proper range, a predetermined electrical signal is generated by sensors 228 and 228′. As belt 20 (and consequently sensor arm 215) moves out of the proper range, the magnetic flux changes as magnets 232 and 232′ move out from between sensors 228 and 228′, translating into a different generated electrical signal. The printed circuit board 230 is connected to computer 300. As the lateral position of belt 20 is being corrected, the Hall effect sensor 226 is used to determine whether the belt 20 is within the proper range. If the belt 20 is back within the proper range, the computer 300 takes no further action in correcting the lateral position of belt 20.

If the lateral position of the belt 20 is to be corrected, the computer 300 operates front pulley pivoting mechanism 202, as discussed below. As shown in FIGS. 2A, 3A, 4 and 10, front pulley pivoting mechanism 202 is used to pivot one end of front pulley 22 either towards the front, or towards the rear of treadmill 10. Specifically, one end of front axle 24 is placed into pivot block 242 which is preferably located at the right end of front axle 24, as illustrated in FIG. 3A. Pivot block 242 is attached to frame 26 by pivot pin 244. As front pulley 22 pivots, pivot block 244 also pivots. The opposite, left end of front axle 24 is therefore moved to pivot the front pulley 22. The left end of the front axle 24 is placed into guide block 246. As guide block 246 is made to move towards the front of treadmill 10, front pulley 22 also pivots forward; as guide pivot block 246 is made to move towards the rear of treadmill 10, front pulley 22 also pivots rearward.

The pivoting of front pulley 22 is used to correct the lateral position of belt 20 in a known manner. If belt 20 is moving too far to the left, the front pulley 22 is pivoted towards the front of treadmill 10. If belt 20 is moving too far to the right, the front pulley 22 is pivoted towards the rear of treadmill 10. Since the belt 20 will tend to move towards the lateral direction where belt tension is lower, the front pulley 22 will be pivoted to create a slack on the side of the belt 20 towards which lateral movement of the belt is desired.

Movement of guide block 246 is controlled by a tracking motor 248, attached to the frame portion 26. Long threaded bolt 250 is attached to motor 248 and extends longitudinally towards the front of treadmill 10. Guide block 246 is moved by rotation of bolt 250, which extends through nut 252 in guide block 246; bolt 250 is attached to guide block 246 by fastener assembly 254, depending on the rotation of bolt 250. If guide block 246 is to be moved towards the front, motor 248 rotates the bolt 250 clockwise, and if guide block 246 is to be moved towards the rear, motor 248 rotates the bolt 250 counterclockwise. As discussed below, computer 300 causes motor 248 to rotate bolt 250 for a predetermined rotation to move guide block 246 for a predetermined distance, resulting in the desired pivot.

As belt 20 begins to move in the desired direction, guide block 246 is moved back to its starting position, substantially transverse across treadmill 10, by rotating bolt 250 in the opposite direction.

FIG. 16 is a functional block diagram illustrating the preferred embodiment of an electronic system using a computer or computer 300 to control the various functions of the treadmill 10. Preferably the computer 300 is composed of two or more interconnected Motorola 6805 or 68HC11 microprocessors. As previously described, the belt 20 is driven by the rear pulley 28 which in turn is driven through the transmission 111 by the A.C. motor 104. The speed of the motor 104, and hence the belt 20 is controlled by the computer 300 through the application of control signals from the computer 300. Single phase 110 volt A.C. power is applied to the A.C. belt drive motor 104 from a conventional A.C. power source, functionally shown at 304, over an A.C. power line 306 which is connected to a terminal of the A.C. power source 304. As previously indicated, the A.C. motor 104 is mechanically connected to the rear pulley 28, as functionally represented by a shaft 302, and is effectively controlled by digital signals from the computer 300 transmitted over a line 308. Specifically, line 308 is used to provide a speed signal to an A.C. motor controller 310 which in turn admits the A.C. current on the line 306 to the motor 104. In the preferred embodiment the A.C. motor 104 and controller 310 are combined in a Emerson Electric 1.5 horsepower motor-controller unit. In this embodiment, the A.C. motor controller 310 accepts digital speed signals from the computer 300 over the line 308 and alters the frequency and voltage of the A.C. current to the motor 104 in such a manner to cause the motor 104 to rotate at the desired speed. In addition, on/off motor signals can be transmitted to the controller 310 over a line 312 from the computer 300 and signals indicating the operating condition of the controller 310 are transmitted over a line 314 to the computer 308.

FIG. 16 also illustrates the operation of a system for sensing the speed of the belt 20. The speed sensor 118 senses the rate of rotation of the pulley 116 shown in FIGS. 3C and 11 and provides a series of pulses to the computer over a line 322 which represents the speed of the belt 20.

Control of the speed of the belt 20 by the computer 300 is provided in the preferred embodiment of the invention in the following manner. The computer 300 compares the actual speed of the belt 20 as measured by the speed sensor 118 to a desired value. If the actual speed differs from the desired value the computer 300 transmits the appropriate speed signal over line 308 to the controller 310 to adjust the speed of the motor 104 to the desired value of treadmill 10. An additional feature which can be included is the mechanical brake functionally represented by a box 316 inserted in the shaft 302. The object of the brake 316 is to prevent the rear pulley 28, and hence the belt 20, from moving when the motor 104 is off. Control of the brake 316 is provided by a signal from the computer 300 over a line 318.

Also functionally illustrated in FIG. 16 is the belt tracking mechanism which includes the sensor 226 that provides an indication of the lateral position of the belt 20 on the front pulley 28. Signals from the sensors 200 and 226 are transmitted as represented by a line 340 to the computer 300. Upon receipt of a left or right deflection signal from the tracking sensor 226, the computer 300 will transmit appropriate control signals over a pair of lines 332 and 334 through interface 301 from lines 331 and 333, respectively, to activate the tracking motor 248 which in turn causes the front pulley 28 by means of the front pulley pivoting mechanism 202 to pivot longitudinally in order to center the belt 20 on the pulley 28. A triac 336, a SPDT switch 338, a left limit switch LL and a right limit switch LR are inserted in the A.C. power line 306 ahead of the tracking motor 248. The tracking sensor 226 transmits a signal over a line 340 to the computer 300 which represents the lateral deflection of the belt 20 on the pulley 28. In response, the computer 300, by means of a signal transmitted over the line 332 from the interface 301, places triac 336 in a conducting state and switches the polarity of the SPDT switch 338 such that the A.C. current is applied through either the LL or LR switch to drive the tracking motor 248 in the appropriate direction to center the belt 20. Limit switches LL and LR also serve to effectively limit the amount of longitudinal travel of the axle 24 of the front pulley 28 by cutting off current to the tracking motor 248 when the predetermined limits are exceeded. An indication of this condition is provided to the computer 300 by a current detecting resistor 342 which is connected to the computer 300 by a line 344.

Inclination of the treadmill 10 is controlled by the computer 300 in a similar manner. As previously described, the inclination sensor or potentiometer 176 detects the inclination of the treadmill and transmits an inclination signal over a line 346 to the computer 300. In response to the inclination signal on the line 346 the computer 300 applies control signals over a pair of lines 348 and 350 to control the inclination motor 166 so as to adjust the inclination of the treadmill to the angle selected either by the user or an exercise program contained in the computer 300. This is accomplished by a triac 352 and a SPDT switch inserted in the A.C. power line 306. When it is desired to increase or decrease the inclination of the treadmill 10, the triac 352 is placed in a conducting condition by a signal on line 348 and the A.C. current is transmitted through the SPDT switch in response to a signal on line 350 and then through either an upper limit switch LU or a lower limit switch LD to the A.C. inclination motor 166. The computer 300 will switch off the triac 352 when it receives a signal over the line 346 indicating that the treadmill is at the desired inclination. Upper and lower limits of operation of the inclination motor 166 are provided by switches LU and LD which serve to disconnect the A.C. current on the line 306 inclination motor 166 when predetermined limits are exceeded. An indication of this out of limit condition is transmitted to the computer 300 by a current detecting resistor 356 over a line 358.

As illustrated in FIG. 16, each of the A.C. motors 104, 166 and 248 are connected to a return power line 359 which in combination with the power line 306 completes the A.C. circuit with the 110 volt A.C. power source 304.

Additionally connected to the computer 300 are the various elements of the control-display panel 18. For simplicity the signals transmitted to and from the computer 300 to the control-display panel 18 are represented by a single line 360. In the preferred embodiment of the invention the panel 18 includes a large stop switch 362 which can readily be activated by a user, that is connected through the interface 301 to computer 300 by a line 361 and a line 363. This switch 362 is provided as a safety feature and activation by the user will result in the computer 300 causing the A.C. belt motor 104 to come to an immediate stop and can also activate the brake 316.

A number of numeric displays are also included on the panel 18 including: an elapsed time display 364 which displays the elapsed time of an exercise program controlled by the computer 300; a mile display 366 which displays the simulated distance traveled by the user during the program; a calorie display 368 which can selectively display, under control of the computer 300, a computation of the current rate of user calorie expenditure or the total calories expended by the user during the program; a speed display 370 representing the current speed of the belt 28 which is transmitted to the computer 300 from the speed sensor 118 over the line 322; an incline display 372 representing the inclination of the treadmill 10 in degrees; and a terrain or a "hill" display 374 which is similar to the LED display disclosed in U.S. Pat. No. 4,358,105. In the preferred embodiment, the computer 300 operating under program control will cause the treadmill to incline so as to correspond to the hills displayed on the terrain display 374. In this manner the user is provided with a display of upcoming terrain. A scrolling alpha-numeric vacuum fluorescent display 376 is also provided for displaying operating instructions to the user, or as previously described, displaying relative impact forces.

Along with the displays 364–376, the panel 18 is provided with an input key pad 378 with which the user can communicate with the computer 300 in order to operate the treadmill 10 as well as program keys indicated at 380 to select a desired exercise program such as manual operation, a predetermined exercise program or a random exercise program. In the preferred embodiment, incline and speed keys indicated at 382 on panel 18 can be used to override the predetermined speeds and inclines of a user selected exercise program.

Figure 18:
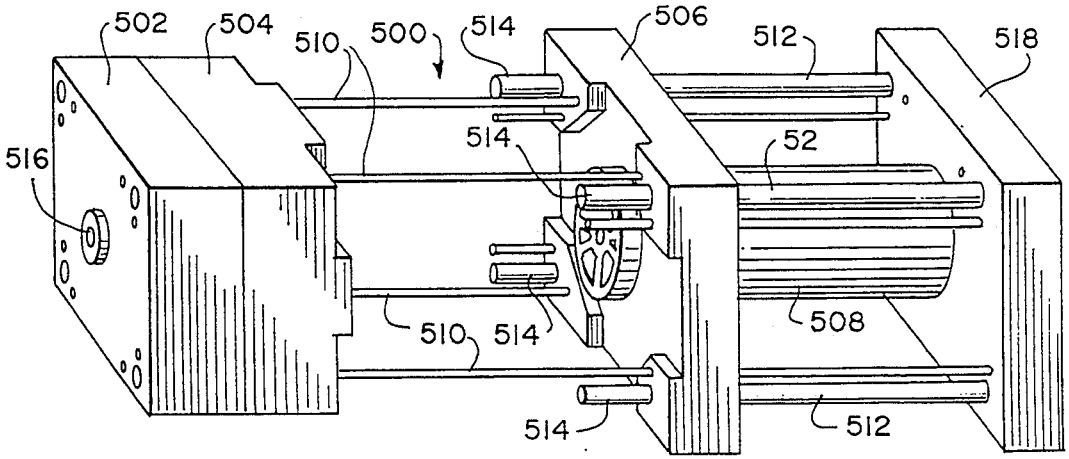
FIG. 18 is a perspective view of a mold useful for forming large diameter treadmill pulleys having integral toothed sprockets.

FIG. 18 illustrates a treadmill pulley body mold 500 useful for molding large diameter plastic pulleys such as pulleys 22 and 28. Mold 500 is shown in an "open" position for purposes of illustration. Mold 500 includes three mold members 502, 504 and 506, each of which shapes about one-third of a molded pulley such as pulley 28. In this example, pulley portions 108, 32 and 34 (see FIG. 6) are molded in mold members 502 and 504, and pulley portion 34' is molded in mold member 506. A core 508 is moveable through members 502, 504 and 506 and causes the formed pulley to be formed with about a ⅛-inch wall thickness as shown in FIG. 5. Members 502 and 504 are slidably moveable on pins 510 so as to mate with member 506 when mold 500 is in a "closed" position for molding.

Core 508 and a core base plate 509 to which core 508 is attached are slidably moveable toward member 506 on pins 512 to insert core 508 within members 502, 504 and 506 when mold 500 is in the closed position. The pin ends 514 distal from base 509 cooperatively mate with complementary apertures in member 506 (not shown) to insure the proper alignment of members 506 and 504.

Pulley 28 is formed by first loading bearing seat insert 48' into mold 500 when mold 500 is in the open position shown in FIG. 18. Members 502, 504 and 506 are then slid together and core 508 is coaxially retained within the mated mold members 502, 504 and 506 by the base portion 509. The pulley is then molded by introducing a hot structural foam and plastic mixture having a 40% glass fill into a material gate 516. The mold is allowed to cool for about 3 to 6 minutes, opened, and the molded pulley ejected. Ejector pins (not shown) in the base plate 509 can be used to facilitate removal of pulley 28 from core 508. End cap 44 can be produced with molded-in bearing seat insert 48 by a similar process.

We claim:

1. An exercise treadmill, comprising:

a frame structure including two rotatable pulleys, said pulleys being positioned substantially parallel to each other, longitudinal frame member means for providing longitudinal support, and at least two longitudinally spaced-apart crossmembers;

means for rotating one of said pulleys;

an endless, movable surface looped around said pulleys to form an upper run and a lower run, said movable surface being rotated when one of said pulleys is rotated, and providing an exercise surface on which a user can walk or run while exercising; and support means for providing support for the upper run of said movable surface including a deck member secured beneath at least a portion of said upper run, said deck member underlying substantially the entire exercise surface, and a plurality of sets of at least two resilient support members secured between said deck member and said crossmembers, said sets being arranged substantially parallel to the pulleys effective to permit said deck member to flex downwardly in response to the impact of the user's feet on said exercise surface.

2. The exercise treadmill of claim 1 wherein one set of said resilient support members has a generally elliptical configuration.

3. The exercise treadmill of claim 2 wherein one set of said resilient support members has a generally cylindrical configuration.

4. The treadmill of claim 3 wherein one end of said cylindrical resilient support member is disposed to said deck member.

5. The treadmill of claim 2 wherein the major axis of said elliptical resilient support member substantially parallels said exercise surface.

6. The treadmill of claim 2 wherein said elliptical resilient support members are constructed from an elastomeric material selected from the group consisting of polystyrene, polycarbonate, polyurethane and polyester.

7. The exercise treadmill of claim 2 wherein said elliptical resilient support members are constructed from a mixture of elastomeric materials selected from the group consisting of polystyrene, polycarbonate, polyurethane and polyester.

8. The exercise treadmill of claim 2 wherein said elliptical resilient support members are constructed from polyphenylene oxide.

9. The exercise treadmill of claim 2 wherein said elliptical resilient support members have a free, uncompressed height in the range of about 1.50 inches to about 3 inches.

10. The exercise treadmill of claim 2 wherein said elliptical resilient support members have an uncompressed diameter in the range of about 1.5 inches to 3 inches.

11. The exercise treadmill of claim 2 wherein said elliptical resilient support members have a compressed height in the range of about 0.5 inches to 2 inches.

12. The exercise treadmill of claim 2 wherein said elliptical resilient support members are constructed from a material having a hardness in the range of about shore 30A to about shore 55A.

13. The exercise treadmill of claim 1 wherein one set of said resilient support members has a generally cylindrical configuration.

14. The treadmill of claim 13 wherein one end of said cylindrical resilient support member is disposed to said deck member.

15. The exercise treadmill of claim 1, wherein said two rotatable pulleys are plastic pulleys having an end diameter in the range of about seven to nine inches.

16. The exercise treadmill of claim 15 wherein said pulleys are constructed from a plastic selected from the group consisting of polyphenylene oxide, polystyrene, polycarbonate, polyurethane, polyester, and polypropylene.

17. The exercise treadmill of claim 15 wherein said pulleys have a cambered configuration including a substantially cylindrical-shaped center portion with conical ends and further including a separate end cap secured to one end of said conical ends.

18. The exercise treadmill of claim 17 wherein said rotating means includes a motor and a gear belt operatively connected to said motor and wherein one of said pulleys includes a sprocket molded on one of said end caps and operatively engaged with said gear belt.

19. The exercise treadmill of claim 1 wherein a first and a second of said sets of said resilient support members are located at each end of said deck member and a third and fourth of said sets of said resilient support members are spaced apart along the length of said deck member intermediate of said first and second sets.

20. The Exercise treadmill of claim 14 wherein the resilient support members in said first and second sets have a generally cylindrical configuration and the resilient support members in said third and fourth sets have a generally elliptical configuration.

21. An exercise treadmill, comprising:

a frame structure including two rotatable pulleys, said pulleys being positioned substantially parallel to each other;

means for rotating one of said pulleys;

an endless, moveable surface looped around said pulleys to form an upper run and a lower run, said moveable surface being rotated when one of said pulleys is rotated; and support means for providing support for the upper run of said moveable surface including a deck member secured beneath at least a portion of said upper run, said deck member having a crowned portion crowned substantially upward between the front and rear of said exercise treadmill.

22. An exercise device for providing an endlessly movable exercise surface comprising:

an exercise treadmill having two rotatable pulleys substantially parallel to each other and an endless moveable exercise surface looped around said pulleys to form an upper run and a lower run, said moveable exercise surface being rotated when one of said pulleys is rotated and providing a surface on which a user can walk or run while exercising;

means for sensing the lateral position of said moveable exercise surface on said pulleys; and means for correcting the lateral position of said moveable exercise surface on said pulleys including pivoting means for pivoting one end of one of said pulleys in a longitudinal direction where said pivoting means includes a first pivot block capable of pivoting movement about a vertical axis into which one end of said pulley to be rotated is rotatable mounted, and a second block into which the other end of said pulley to be rotated is rotatably mounted, and further including means for moving said second block through said longitudinal direction.

23. An exercise treadmill, comprising:

endless belt means including two rotatable pulleys substantially parallel to each other and an endless belt looped around said pulleys, said belt being rotated when one of said pulleys is rotated for providing a movable exercise surface;

a support deck located below a portion of said belt means for limiting the downward deflection of the exercise surface;

a treadmill frame having longitudinal and lateral frame members; and a plurality of sets of at least two vertically oriented cylindrical elastomeric deck support members fastened between said deck and said frame for allowing the deck to move in the longitudinal and lateral horizontal directions and for limiting movement of said deck in the vertical direction.

24. The treadmill of claim 23 wherein said cylindrical support members are from 0.5 to 3 inches in uncompressed height and substantially formed from a rubber or an elastomeric material.

25. The treadmill of claim 24 wherein at least one said cylindrical support member includes an axially oriented threaded aperture for receiving a support deck securing screw.

26. The treadmill of claim 24 wherein at least one said cylindrical support member includes an axially directed threaded member for threadably mounting the support member to one of said frame members.

27. The treadmill of claim 24 wherein said support deck is rectangular and has four corners, and wherein at least one cylindrical support member is located near each corner of the deck.

28. The exercise treadmill of claim 23 further including a plurality of elliptical resilient support members secured between said support deck and said frame.

29. The treadmill of claim 28 wherein said elliptical resilient support members are constructed from an elastomeric material selected from the group consisting of polystyrene, polycarbonate, polyurethane and polyester.

30. The exercise treadmill of claim 28 wherein said elliptical resilient support members are constructed from a mixture of elastomeric materials selected from the group consisting of polystyrene, polycarbonate, polyurethane and polyester.

31. The exercise treadmill of claim 28 wherein said elliptical resilient support members are constructed from polyphenylene oxide.

32. The exercise treadmill of claim 28, wherein said elliptical resilient support members have a free, uncompressed height in the range of about 1.50 inches to about 3 inches.

33. The exercise treadmill of claim 28 wherein said elliptical resilient support members have an uncompressed diameter in the range of about 1.5 inches to 3 inches.

34. The exercise treadmill of claim 28 wherein said elliptical resilient support members have a compressed height in the range of about 0.5 inches to 2 inches.

35. The exercise treadmill of claim 28 wherein said elliptical resilient support members are constructed from a material having a hardness in the range of about shore 30A to about shore 55A.

36. An exercise treadmill, comprising:

a frame structure including two substantially parallel, rotatable pulleys and at least two longitudinally spaced apart cross-members;

an endless, moveable surface looped around said pulleys to provide an exercise surface on which a user can walk or run while exercising, said moveable surface being rotated when one of said pulleys is rotated;

a deck for supporting said exercise surface from below when a user's foot impacts said exercise surface, said deck underlying substantially the entire length of said exercise surface; and a plurality of non-inflatable, elastomeric support members effective to permit said deck to flex downwardly in response to the impact of the user's foot on said exercise surface, said support members being secured between said deck and said cross-members.

37. An exercise treadmill, comprising:

a frame structure including two rotatable pulleys, said pulleys being positioned substantially parallel to each other, and two laterally spaced apart longitudinal support members;

means for rotating one of said pulleys;

an endless, moveable surface looped around said pulleys to form an upper run and a lower run, said movable surface being rotated when one of said pulleys is rotated, and providing an exercise surface on which a user can walk or run while exercising;

a deck member secured beneath at least a portion of said upper run;

a first plurality of elastomeric support members aligned with a first of said longitudinal support members and positioned intermediate of said pulleys; and a second plurality of elastomeric support members aligned with a second of said longitudinal support members and positioned intermediate of said pulleys;

wherein said elastomeric support members are secured between said frame and said deck to permit said deck to flex downwardly in response to the impact of the user's feet on said exercise surface.

38. The treadmill of claim 37 wherein said first plurality of elastomeric support members includes at least two of said first elastomeric support members spaced apart along said first longitudinal support member and wherein said second plurality of elastomeric support members includes at least two of said second elastomeric support members spaced apart along said second longitudinal support member.

39. The treadmill of claim 37 wherein a first one of said first plurality of elastomeric support members and a first one of said second plurality of said second elastomeric support members are located at a first end of said deck member, a second one of said first plurality of elastomeric support members and a second one of said second plurality of elastomeric support members are located at a second end of said deck member, a third one of said plurality of said first plurality of elastomeric support members is located intermediate of said first one and second one of said first plurality of elastomeric support members, and a third one of said second plurality of elastomeric support members is located intermediate of said first one and second of said second one plurality of elastomeric support members.

* * * * *

US005382207B1

REEXAMINATION CERTIFICATE (3592nd)

United States Patent [19] [11] B1 5,382,207

Skowronski et al. [45] Certificate Issued Aug. 4, 1998

[54] EXERCISE TREADMILL

[75] Inventors: Richard E. Skowronski, Elk Grove Village; Kenneth F. Lantz, Oak Park; Tomas F. Leon, Chicago, all of Ill.; Donald J. Alexander, Milwaukee, Wis.; George Kolomayets, Chicago, Ill.; Vincent C. Adams, Buffalo Grove, Ill.; Eugene B. Szymczak, Glen Ellyn, Ill.

[73] Assignee: Life Fitness, Inc., Franklin Park, Ill.

Reexamination Requests:
No. 90/004,144, Feb. 20, 1996
No. 90/004,296, Jul. 8, 1996
No. 90/004,860, Dec. 9, 1997

Reexamination Certificate for:

| | |
|---|---|
| Patent No.: | **5,382,207** |
| Issued: | **Jan. 17, 1995** |
| Appl. No.: | **686,906** |
| Filed: | **Apr. 17, 1991** |

Related U.S. Application Data

[63] Continuation-in-part of Ser. No. 452,885, Dec. 19, 1989, abandoned, which is a continuation-in-part of Ser. No. 368,450, Jun. 19, 1989, abandoned.

[51] Int. Cl.[6] ..... A63B 22/02

[52] U.S. Cl. ..... 482/54; 482/6; 482/900; 482/901; 482/904; 198/807; 474/101

[56] References Cited

U.S. PATENT DOCUMENTS

| | | | |
|---|---|---|---|
| 3,105,252 | 10/1963 | Milk . | |
| 3,800,493 | 4/1974 | Livingston . | |
| 3,824,067 | 7/1974 | Voshel | 198/841 X |
| 3,994,261 | 11/1976 | Wedell et al. . | |
| 4,070,427 | 1/1978 | Romualdi et al. . | |
| 4,350,336 | 9/1982 | Hanford . | |
| 4,659,074 | 4/1987 | Taitel et al. | 482/54 |
| 4,696,357 | 9/1987 | Beehler et al. | 177/145 |
| 4,786,049 | 11/1988 | Lautenschlager | 482/902 X |
| 4,938,475 | 7/1990 | Sargeant et al. | 482/902 X |
| 4,981,136 | 1/1991 | Chance . | |
| 5,007,528 | 4/1991 | Hideharu | 198/841 X |
| 5,336,144 | 8/1994 | Rodden . | |

FOREIGN PATENT DOCUMENTS

| | | | |
|---|---|---|---|
| 2 616 132 | 12/1988 | France . | |
| 1347953 | 10/1987 | U.S.S.R. | 482/54 |

OTHER PUBLICATIONS

Newspaper Article related to Technical Machines Speciales Treadmill (Exhibit 1022), 1988.
Paulastra Hutchinson Catalogue (Exhibit 1030a), 1983.
Paulastra Catalogue (Exhibit 1031a), 1990.
Selected Pages from Grainger 1995 General Catalog No. 386.
ASMCO Catalog No. 93, pp. 150, 217, 1993.
Machinery's Handbook, Twenty–first ed., pp. 1152, 1153, 1162, 1163, 1981.
"Instructions de Service," (Maintenance Manual for Treadmill) TMS, France, Oct. 1988, 14 pp.
"Precor USA," Promotion brochure for Precor Treadmills models 910ei and 935e, 4 pp., 1985.
"Precor USA," Promotion brochure for Precor Treadmills model 905e, 2 pp., 1988.

*Primary Examiner*—Joe H. Cheng

[57] ABSTRACT

To improve tracking, an exercise treadmill is provided with a frame including molded plastic pulleys, having an integral gear belt sprocket, an endless belt extending around the pulleys and a motor operatively connected to the rear pulley to drive the belt. The pulleys are molded out of plastic and have a diameter of approximately nine inches. A mold and method for producing large diameter treadmill pulleys having an integrally molded sprocket are also disclosed. A deck underneath the running surface of the belt is supported by resilient members. A positive lateral belt tracking mechanism is used to correct the lateral position of the belt. A belt position sensor mechanism is used in combination with a front pulley pivoting mechanism to maintain the belt in the desired lateral position on the pulleys. The exercise treadmill also includes a lift mechanism with an internally threaded sleeve engaged to vertically aligned nonrotating screws. A user display of foot impact force on the belt is also provided.

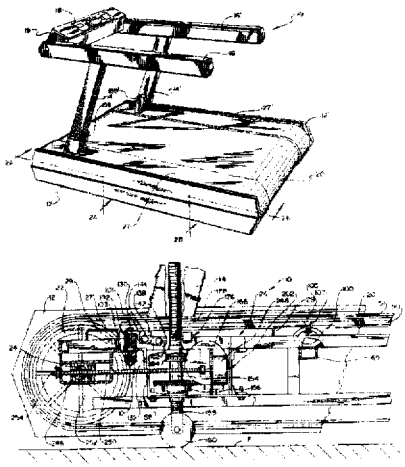

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–39 are confirmed.

* * * * *